US008469223B2

(12) United States Patent
Perry et al.

(10) Patent No.: US 8,469,223 B2
(45) Date of Patent: Jun. 25, 2013

(54) STRENGTH CONTAINER

(75) Inventors: James P. Perry, Gahanna, OH (US); Mark A. Bennett, Loveland, OH (US); Martin J. Gibler, West Chester, OH (US); Marc A. Pedmo, Litchfield, OH (US); Sean P. Cronican, Folsom, CA (US); Jeremy J. McBroom, New Albany, OH (US); John G. Barca, Dublin, OH (US); David E. Compeau, Oxford, MI (US); Gregory J. Finn, White Lake, MI (US)

(73) Assignee: Abbott Laboratories, Abbott Park, IL (US)

( * ) Notice: Subject to any disclaimer, the term of this patent is extended or adjusted under 35 U.S.C. 154(b) by 802 days.

(21) Appl. No.: 12/534,320

(22) Filed: Aug. 3, 2009

(65) Prior Publication Data

US 2010/0308044 A1 Dec. 9, 2010

Related U.S. Application Data

(63) Continuation-in-part of application No. 12/478,885, filed on Jun. 5, 2009.

(51) Int. Cl.
*B65D 41/56* (2006.01)
*B65D 8/12* (2006.01)

(52) U.S. Cl.
USPC ..... 220/608; 220/212; 220/254.3

(58) Field of Classification Search
USPC ..... 220/669, 254.3, 258.2, 259.1, 608, 220/609, 212
See application file for complete search history.

(56) References Cited

U.S. PATENT DOCUMENTS

| | | | |
|---|---|---|---|
| 711,452 | A | 10/1902 | Meyer |
| 2,648,097 | A | 8/1953 | Kritchever |
| 3,038,624 | A | 6/1962 | Wieckmann |
| 3,338,468 | A | 8/1967 | Wilson |
| 3,613,964 | A | 10/1971 | Gronemeyer |
| 3,966,062 | A | 6/1976 | Hopkins |

(Continued)

FOREIGN PATENT DOCUMENTS

| | | | |
|---|---|---|---|
| CN | 2936980 | Y | 8/2007 |
| CN | 201144030 | Y | 11/2008 |

(Continued)

OTHER PUBLICATIONS

ASG vitamin package of 1990.

(Continued)

*Primary Examiner* — Mickey Yu
*Assistant Examiner* — Niki Eloshway
(74) *Attorney, Agent, or Firm* — Calfee, Halter & Griswold LLP

(57) ABSTRACT

A sealable container (210) for flowable material formed with top (212) and flexible and stiffened bottom (214) walls joined by front (216), rear (218), and opposite side walls (220, 222). The top wall including an openable lid (D) formed with an improved scoop holder (30) and a collar (300) received about a finish (282) of the front, rear, and side walls. The flexible and stiffened bottom wall (214) includes at least one sagittal stiffening channel (500) and an optional transverse stiffening channel (530). The openable lid includes a sealing wall (340) that cooperates with other improved container components to prevent spillage of the flowable material after the seal is peeled and removed.

6 Claims, 9 Drawing Sheets

U.S. PATENT DOCUMENTS

| | | | | | |
|---|---|---|---|---|---|
| 4,000,816 | A | | 1/1977 | Spruyt | |
| 4,089,433 | A | * | 5/1978 | Jonsson | 215/218 |
| 4,095,716 | A | | 6/1978 | Meany | |
| 4,293,079 | A | | 10/1981 | Lytle | |
| 4,321,922 | A | | 3/1982 | Deaton | |
| 4,408,698 | A | | 10/1983 | Ballester | |
| 4,577,775 | A | * | 3/1986 | Kresin | 220/604 |
| 4,727,999 | A | | 3/1988 | Gach | |
| 4,736,870 | A | | 4/1988 | Christensson | |
| 4,883,193 | A | | 11/1989 | Christensson | |
| 4,971,220 | A | | 11/1990 | Kaufman et al. | |
| 5,046,659 | A | | 9/1991 | Warburton | |
| 5,050,763 | A | | 9/1991 | Christensson et al. | |
| 5,065,887 | A | | 11/1991 | Schuh et al. | |
| 5,078,296 | A | | 1/1992 | Amidzich | |
| 5,145,088 | A | | 9/1992 | Goujon | |
| 5,204,130 | A | | 4/1993 | McDevitt et al. | |
| 5,219,087 | A | | 6/1993 | Christensson | |
| 5,305,900 | A | * | 4/1994 | Maguire et al. | 215/245 |
| 5,337,911 | A | | 8/1994 | Holub | |
| 5,353,946 | A | | 10/1994 | Behrend | |
| 5,366,104 | A | | 11/1994 | Armstrong | |
| 5,383,558 | A | | 1/1995 | Wilkinson et al. | |
| 5,429,833 | A | | 7/1995 | Wyslotsky | |
| 5,515,993 | A | | 5/1996 | McManus | |
| 5,518,152 | A | | 5/1996 | Burcham et al. | |
| 5,582,314 | A | * | 12/1996 | Quinn et al. | 220/326 |
| 5,598,941 | A | | 2/1997 | Semersky et al. | |
| 5,641,084 | A | | 6/1997 | Rice | |
| 5,706,974 | A | | 1/1998 | Murdick et al. | |
| 5,718,350 | A | | 2/1998 | Williams | |
| 5,794,566 | A | | 8/1998 | Goetz et al. | |
| 5,810,188 | A | | 9/1998 | Novakoski | |
| 5,897,011 | A | | 4/1999 | Brilliant et al. | |
| 5,897,036 | A | | 4/1999 | Decoster et al. | |
| 5,931,323 | A | | 8/1999 | Wilkinson et al. | |
| 6,006,901 | A | | 12/1999 | Pereira Da Silva | |
| 6,042,000 | A | | 3/2000 | Kawamoto | |
| D444,027 | S | | 6/2001 | Gilliam et al. | |
| 6,269,969 | B1 | | 8/2001 | Huang et al. | |
| 6,520,370 | B2 | | 2/2003 | Nyman et al. | |
| D473,140 | S | | 4/2003 | Gilliam et al. | |
| 6,609,633 | B1 | | 8/2003 | Dyble et al. | |
| 6,644,494 | B2 | | 11/2003 | Hayes et al. | |
| D484,797 | S | | 1/2004 | Kipperman et al. | |
| 6,761,279 | B1 | | 7/2004 | Martin et al. | |
| 6,761,283 | B1 | | 7/2004 | Gilliam et al. | |
| 6,772,904 | B1 | | 8/2004 | Gilliam et al. | |
| D504,318 | S | | 4/2005 | Lane et al. | |
| 6,889,866 | B2 | | 5/2005 | Gilliam et al. | |
| 6,964,359 | B1 | | 11/2005 | Darr et al. | |
| 7,040,500 | B2 | | 5/2006 | Kipperman et al. | |
| 7,080,754 | B2 | | 7/2006 | Lown | |
| D528,919 | S | | 9/2006 | Kipperman et al. | |
| D530,616 | S | | 10/2006 | Kipperman et al. | |
| D530,617 | S | | 10/2006 | Little et al. | |
| 7,156,265 | B2 | | 1/2007 | Walsh et al. | |
| 7,175,041 | B2 | | 2/2007 | Ekkert | |
| 7,370,788 | B1 | | 5/2008 | Otani et al. | |
| 7,621,417 | B2 | | 11/2009 | Peterson et al. | |
| 8,308,008 | B2 | | 11/2012 | Perry et al. | |
| 2001/0035424 | A1 | | 11/2001 | Combe et al. | |
| 2002/0117504 | A1 | | 8/2002 | Emerson et al. | |
| 2002/0190112 | A1 | | 12/2002 | Culeron et al. | |
| 2003/0015542 | A1 | | 1/2003 | Nulty et al. | |
| 2003/0072440 | A1 | | 4/2003 | Murray et al. | |
| 2003/0121941 | A1 | | 7/2003 | Walsh et al. | |
| 2003/0183540 | A1 | | 10/2003 | Onishi | |
| 2003/0218020 | A1 | | 11/2003 | Gilliam et al. | |
| 2004/0011811 | A1 | | 1/2004 | McLelland et al. | |
| 2004/0118848 | A1 | | 6/2004 | Marshall | |
| 2004/0159661 | A1 | | 8/2004 | Aochi | |
| 2004/0238553 | A1 | | 12/2004 | Lane et al. | |
| 2005/0035118 | A1 | | 2/2005 | Garg et al. | |
| 2005/0173442 | A1 | | 8/2005 | Gilliam et al. | |
| 2005/0247708 | A1 | | 11/2005 | Golden | |
| 2005/0247709 | A1 | | 11/2005 | Atkins et al. | |
| 2006/0027585 | A1 | | 2/2006 | Clamage | |
| 2006/0076352 | A1 | | 4/2006 | Peterson et al. | |
| 2006/0081641 | A1 | | 4/2006 | Habeger et al. | |
| 2006/0131347 | A1 | | 6/2006 | Nottingham et al. | |
| 2006/0156811 | A1 | | 7/2006 | Borowski et al. | |
| 2006/0191933 | A1 | | 8/2006 | Hicks et al. | |
| 2006/0201946 | A1 | | 9/2006 | Witt | |
| 2006/0207963 | A1 | | 9/2006 | Little et al. | |
| 2006/0219652 | A1 | | 10/2006 | Grant et al. | |
| 2006/0273118 | A1 | | 12/2006 | Walsh et al. | |
| 2007/0015046 | A1 | | 1/2007 | Kim et al. | |
| 2007/0045315 | A1 | * | 3/2007 | Evans et al. | 220/254.3 |
| 2007/0221605 | A1 | | 9/2007 | Pugne et al. | |
| 2007/0235462 | A1 | | 10/2007 | Omdoll et al. | |
| 2007/0284276 | A1 | | 12/2007 | Luttick et al. | |
| 2008/0035637 | A1 | | 2/2008 | Shehadey et al. | |
| 2008/0041861 | A1 | | 2/2008 | Crawford et al. | |
| 2008/0156805 | A1 | | 7/2008 | Perry et al. | |
| 2008/0156806 | A1 | | 7/2008 | Perry et al. | |
| 2008/0156808 | A1 | | 7/2008 | Perry et al. | |
| 2008/0156858 | A1 | | 7/2008 | Perry et al. | |
| 2008/0173657 | A1 | | 7/2008 | Perry et al. | |
| 2009/0014457 | A1 | | 1/2009 | Bennett | |
| 2009/0032545 | A1 | | 2/2009 | Zeiler et al. | |
| 2009/0039708 | A1 | | 2/2009 | Sanfilippo et al. | |
| 2009/0152280 | A1 | * | 6/2009 | Luburic | 220/669 |
| 2009/0159607 | A1 | | 6/2009 | Kratzer | |
| 2009/0230177 | A1 | | 9/2009 | Robertson et al. | |
| 2009/0255942 | A1 | | 10/2009 | Omdoll et al. | |
| 2009/0289066 | A1 | | 11/2009 | DiPietro et al. | |
| 2009/0314775 | A1 | | 12/2009 | Dietrich et al. | |
| 2010/0108670 | A1 | | 5/2010 | Perry et al. | |
| 2010/0180553 | A1 | | 7/2010 | Tilton | |
| 2010/0294767 | A1 | | 11/2010 | Catteau et al. | |
| 2010/0308065 | A1 | | 12/2010 | Vandamme et al. | |
| 2010/0308066 | A1 | | 12/2010 | Perry et al. | |
| 2011/0006066 | A1 | | 1/2011 | Vandamme et al. | |

FOREIGN PATENT DOCUMENTS

| | | | | |
|---|---|---|---|---|
| DE | 197 01 101 | A1 | | 7/1998 |
| DE | 197 25 698 | A1 | | 12/1998 |
| EP | 0 356 322 | B1 | | 2/1990 |
| EP | 0 609 650 | A1 | | 8/1994 |
| EP | 0 631 941 | B1 | | 1/1995 |
| EP | 0 648 681 | A1 | | 4/1995 |
| EP | 0 700 836 | A2 | | 3/1996 |
| EP | 0 957 034 | A1 | | 11/1999 |
| EP | 1 129 957 | A1 | | 9/2001 |
| EP | 1 156 157 | A1 | | 11/2001 |
| EP | 1 336 569 | B1 | | 8/2003 |
| EP | 1512637 | A1 | | 3/2005 |
| EP | 1 529 737 | B1 | | 5/2005 |
| FR | 2719558 | | | 11/1995 |
| FR | 2747107 | | | 10/1997 |
| GB | 2059920 | A | * | 4/1981 |
| JP | 8-183556 | | | 7/1996 |
| JP | 8-217108 | | | 8/1996 |
| JP | 8217108 | | | 8/1996 |
| JP | 10258841 | | | 9/1998 |
| JP | 2001019006 | | | 1/2001 |
| JP | 2002-209770 | | | 7/2002 |
| JP | 2004136959 | A | | 5/2004 |
| JP | 2004329382 | | | 11/2004 |
| JP | 2005022757 | | | 1/2005 |
| JP | 2006111294 | | | 3/2006 |
| JP | 2006-160299 | | | 6/2006 |
| JP | 2007099281 | | | 4/2007 |
| JP | 2007099287 | | | 4/2007 |
| JP | 2007099294 | | | 4/2007 |
| JP | 2007137510 | | | 6/2007 |
| JP | 2008063009 | | | 3/2008 |
| JP | 2008296929 | | | 12/2008 |
| KR | 20020007210 | | | 1/2001 |
| KR | 20020025817 | | | 4/2002 |
| KR | 20020025817 | | | 11/2002 |
| KR | 20030072440 | | | 9/2003 |
| KR | 20030089935 | | | 11/2003 |
| KR | 10-2002-0040057 | | | 1/2004 |
| KR | 20040005481 | | | 1/2004 |
| KR | 20050027042 | | | 3/2005 |

| | | | |
|---|---|---|---|
| KR | 200403040 | | 12/2005 |
| KR | 20050019526 | | 12/2005 |
| KR | 10-2002-0027862 | | 4/2009 |
| NL | 1031829 | | 11/2007 |
| WO | 9317920 | | 9/1993 |
| WO | WO 95/11834 | | 5/1995 |
| WO | WO 98/46494 | | 10/1998 |
| WO | WO 99/15423 | | 4/1999 |
| WO | WO 01/51378 | A1 | 7/2001 |
| WO | WO 03/051732 | A1 | 6/2003 |
| WO | 2005075314 | | 8/2005 |
| WO | 2007131806 | | 11/2007 |
| WO | 2007137776 | A1 | 12/2007 |
| WO | 2007142522 | | 12/2007 |
| WO | 2008083141 | A2 | 7/2008 |
| WO | 2008149006 | | 12/2008 |
| WO | 2008149007 | | 12/2008 |
| WO | 2009081050 | | 7/2009 |
| WO | 2010141841 | | 12/2010 |
| WO | 2010141844 | | 12/2010 |

OTHER PUBLICATIONS

Hardware Source hinge store—where you find all the hinges you will ever need, www.hardwaresource.com/index.asp, Dec. 26, 2006, pp. 1-3.

Living Hinge, www.efunda.com/designstandards/plastic_design/hinge.cfm, Nov. 2, 2006, pp. 1-3.

Living Hinge Design, http://engr.bd.psu.edu/pkoch/plasticdesign/living_hinge.htm, Nov. 6, 2006, pp. 1-8.

Request for Inter Partes Reexamination of U.S. Patent No. 7,040,500, Nov. 7, 2008, pp. 1-97.

International Search Report for PCT/US2010/037436, dated Aug. 12, 2010.

International Search Report for PCT/US2007/088793 dated Jun. 10, 2008.

International Preliminary Report on Patentability for PCT/US2007/088793 dated Jun. 30, 2009.

Notice of Abandonment for U.S. Appl. No. 11/645,887 dated Dec. 5, 2008.

Notice of Abandonment for U.S. Appl. No. 11/964,491 dated Dec. 5, 2008.

Notice of Abandonment for U.S. Appl. No. 11/964,513 dated Dec. 5, 2008.

Notice of Abandonment for U.S. Appl. No. 11/964,526 dated Dec. 5, 2008.

Notice of Abandonment for U.S. Appl. No. 11/964,547 dated Dec. 5, 2008.

Office Action in U.S. Appl. No. 12/478,885 dated Mar. 13, 2012.

Amendment A/Response to Office Action in U.S. Appl. No. 12/478,885 dated May 17, 2012.

Office Action in U.S. Appl. No. 12/478,885 dated Oct. 9, 2012.

Office Action in U.S. Appl. No. 12/520,652 dated Dec. 12, 2011.

Response/Amendment A in U.S. Appl. No. 12/520,652 dated Mar. 5, 2012.

Final Office Action in U.S. Appl. No. 12/520,652 dated May 10, 2012.

Notice of Allowance in U.S. Appl. No. 12/520,652 dated Jul. 11, 2012.

Preliminary Amendment A in U.S. Appl. No. 13/083,207 dated Apr. 8, 2011.

Preliminary Amendment B in U.S. Appl. No. 13/083,207 dated Apr. 13, 2011.

Office Action in U.S. Appl. No. 13/083,207 dated Sep. 5, 2012.

Notice of Allowance in U.S. Appl. No. 13/083,207 dated Jan. 24, 2013.

Office Action in Columbian Appl. No. 09066736 dated Sep. 18, 2012.

Office Action in Israeli Appl. No. 199511 (PCT/US2007/088793) dated Feb. 10, 2012.

Office Action in Japanese Appl. No. 2009-544244 dated Jul. 31, 2012.

Office Action in Mexican Appl. No. MX/a/2009/007052 dated Mar. 1, 2012.

Response/Amendment B in U.S. Appl. No. 12/520,652 dated Jun. 28, 2012.

* cited by examiner

FIG. 7
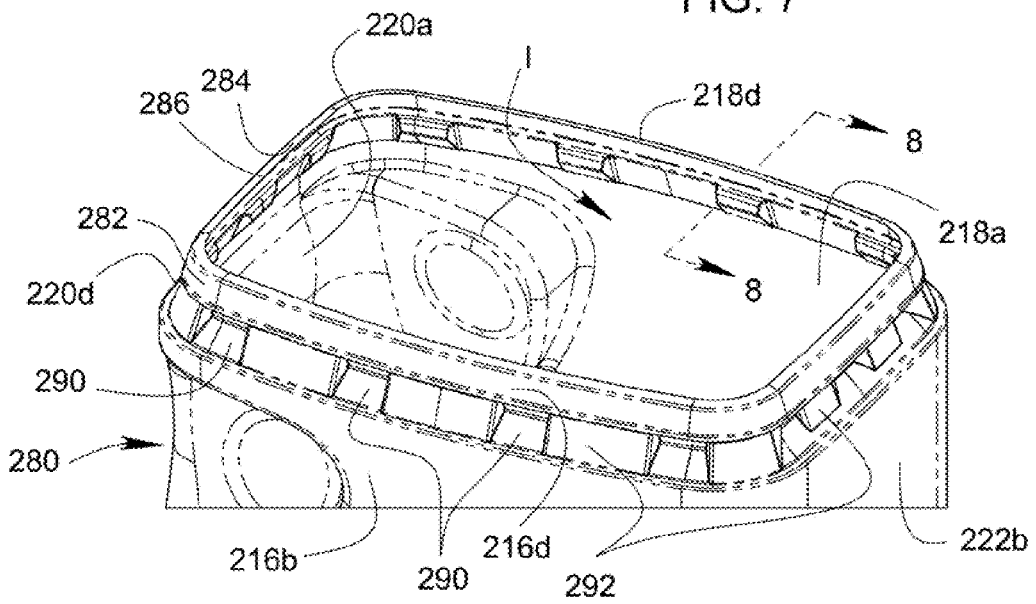
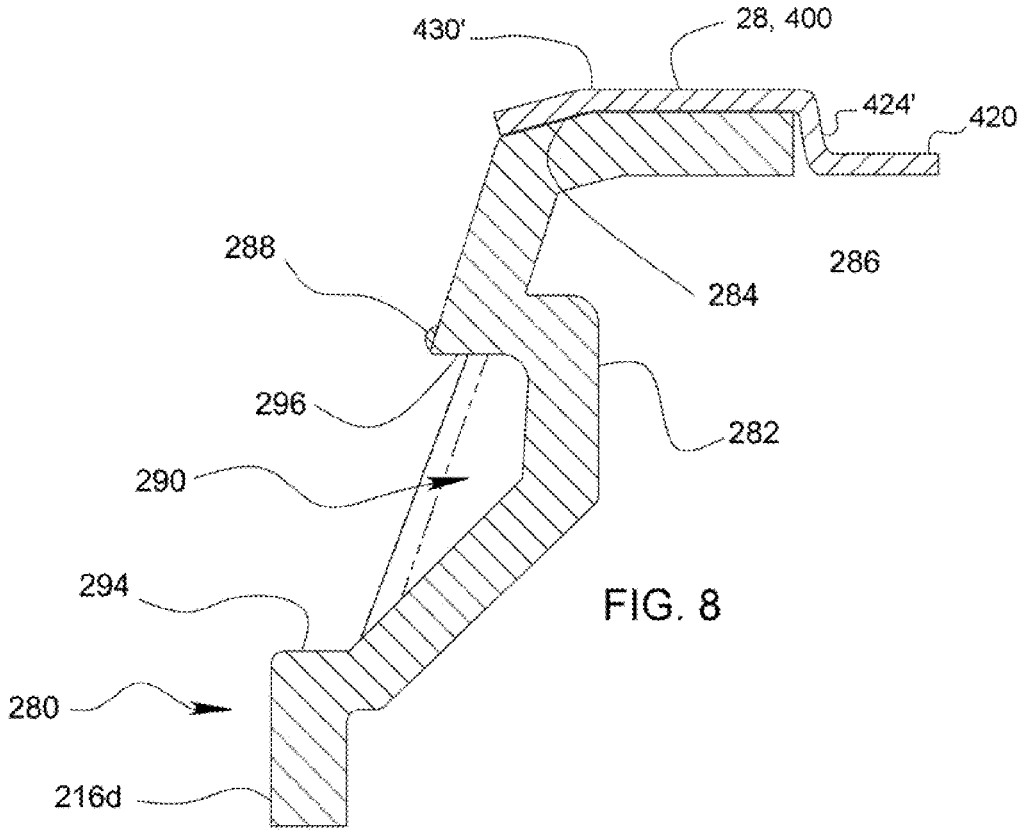
FIG. 8

STRENGTH CONTAINER

PRIORITY CLAIM TO RELATED APPLICATION

This application claims the benefit of the earlier filing date of commonly owned and co-pending U.S. patent application Ser. No. 12/478,885, filed Jun. 5, 2009, and entitled CONTAINER, which is hereby incorporated by reference in its entirety as though fully set forth in the present application. This application is a continuation in part of U.S. patent application Ser. No. 12/478,885, filed Jun. 5, 2009,

BACKGROUND OF THE INVENTION

1. Field of the Invention

This invention relates to the field of packaging, and more particularly, packaging for flowable, granular, or granulated products, such as for example, a powder.

2. Description of Related Art

Currently, substantially flowable products having a granular, granulated, or powdered form, such as, for purposes of example without limitation, powdered infant formula, milk, flour, spices, nutritional supplements, coffee, and sugar, are packaged in containers. Scoops are often supplied within the package for measured dispensing of container contents. Despite many attempted improvements over the years, manufacturers, distributors, consumers, and users of such packaging and containers have continued to experience a number of difficulties and challenges, and continue to strive for improvements.

Manufacturers have attempted to fabricate packages, receptacles, and containers that are easy to fabricate and mold, clean, fill, hermetically and or aseptically seal, transport to market, and that can just as easily be opened and used by consumers and users. Distributers such as transportation entities and marketplace retailers have sought containers that are easily transported, stored, and arranged and displayed on store shelves. Consumers have demanded packages and containers that have an attractive, sanitary, and high-quality appearance during the shopping experience, which have remained sealed to ensure integrity of product in the container, and that are easy-to-open and reseal during use.

Manufacturers have also endeavored to address user needs to remove the last quantity of powder or other contents from nearly empty containers by configuring one or more portions of the container to have a shape that cooperates with the shape of the scoop. See, for example, co-owned and published U.S. Patent Application No. 20080173657 entitled "Container and Congruent Scoop Assembly", and co-owned and co-pending U.S. patent application Ser. No. 12/478,885 filed Jun. 5, 2009, which are hereby incorporated by reference in their entirety as though fully set forth herein.

Manufacturers of such containers have also experienced a number of challenges in fabricating the containers when using various types of optionally preferred thermo-forming and polymeric manufacturing processes and materials. In many prior art attempts to manufacture such containers, various thermo-molding processes are used, each fraught with its own set of challenges.

Such materials are subject to many variables that adversely and unexpectedly result in product components being produced that can vary beyond acceptable dimensional tolerance limits, which results in the need to scrap defective containers and components of such container, and the need to produce replacements. Also, during the molding process, polymeric materials can render mis-shaped component profiles due to unexpected shrinkage and warping, unexpectedly ineffective molding flow rates, unreliable or difficult-to-control blow-molding techniques, and other thermo-forming anomalies, any of which can result in containers and components for containers having undesirable problems.

Typical problems can include large and pin-hole-type leaks, undesirably thin elements or walls of the containers that lower strength and stiffness that in turn can result in poor sealing after filling and poor resistance to post-manufacture, nominal handling and transportation environments. These types of challenges are compounded when non-uniform or asymmetric container shapes are sought. In the past, many polymeric containers have been successfully fabricated to have substantially cylindrical and uniform shapes. However, more recent market demands have given rise to containers having cuboid or substantially rectilinear shapes, which have resulted in asymmetrical features that have been difficult and even impossible for many manufacturers to achieve.

Other issues of importance to manufacturers and consumers alike include controlling costs of the manufacturing process to ensure consumers a desirable price while also striving to maximize efficiency of the manufacturing process to minimize adverse environmental impact. Also of concern is the need to reduce the amount of polymeric and other materials needed to produce a suitable container, and establish a fair rate of return by controlling manufacturing costs, all of which encourages manufacturers to produce much-needed products.

Despite a variety of improved container designs and new ways to fabricate containers and packaging, manufacturers and users of such containers have continued to encounter issues with filled and sealed containers due to fluctuations in external ambient air pressure after filling and sealing. As filled and sealed containers leave the factory and move through the supply chain, they can be subjected to substantial ambient atmospheric pressure differentials.

Those with knowledge in the field of hermetically sealed containers have long sought to create containers that can be hermetically and aseptically sealed, but which can also withstand the nominal pressure differentials associated with product-filled containers that must be delivered to market via air, rail, and roads across a wide range geography and altitude-related pressure changes. These transportation circumstances are often experienced when a manufacturer delivers containers that are filled and sealed at a sea-level or higher altitude factory. Anomalies can occur when such containers then transit to market via ground over mountains and via aircraft for delivery to stores that may be located at higher or lower elevations.

If the transit and final destination pressure differentials are large, the filled and sealed container can experience an over or under pressure condition that may permanently deform the container. In extreme situations, the container and or the container seal may rupture leaving the contents or powdered product unsalable. Conversely, containers filled and sealed at higher elevation factories can experience crushing external pressure having similar effects.

In each instance, a deformed container may be rendered unattractive to a consumer and in a condition unsuitable for easy storage, stacking, and display on a store shelf. Also, when a sealed container has an internal pressure that is different from the outside air pressure, the contents may suddenly escape in a puff when pressure equalizes as the seal is peeled away and opened, which may create an unfavorable impression on a consumer or user.

Despite advances in many areas of container design that have improved usability, consumers have continued to seek products containers that are easier to use. One area of continued consumer attention includes integral scoop holders. Past container designs have been directed to various methods of including a scoop with the container. In the simplest form, a scoop is simply included inside the container with the product contents or powdered material. In other more elaborate designs, a scoop holder has been attached to a wall or a lid of the container.

While the latter scoop holder approach has seen some acceptance, consumer satisfaction could be increased with less complex and easier to use designs. In past attempts, scoop holders have incorporated many parts that have created challenges for consumer use when parts break or detach and fall into the container, and which render the holder unserviceable. Consumers have also expressed that improvements could be made in producing high-integrity seals that are also easy to remove. Past attempts at fabricating strong seals that can withstand the rigors of post-filling and sealing transportation environments had lead to very strong, high-quality seal technologies. However, consumers have had trouble in opening the seals wherein the seals tear during removal and become difficult to remove in their entirety. This often requires multiple attempts to remove the seals that can lead to user frustration and product dissatisfaction.

What has long been needed in the field of art is a container that addresses the many issues surrounding prior art containers. More importantly, an improved container and product receptacle is needed that offers new and innovative ways to prevent and or minimize contamination, spillage, and waste of product contained in such containers, while enabling better manufacturing cost controls and greater ease and convenience of use for users and consumers.

Despite many attempts, manufacturers, distributors, users, and consumers have remained convinced that further improvements are possible. The market continues to seek a higher-quality container that incorporates all of the advantages of the prior art but which can better withstand the post-manufacturing transportation environment including pressure differentials, while offering great convenience and ease of use.

SUMMARY OF THE INVENTION

Many of the problems of the prior art and sought after improvements in the field of sealable container technology are addressed with the innovative sealable containers of the invention. The improvements described herein enable previously unavailable features including improved sealing capabilities and integrated dispensing scoops having easier to use holder features. Also addressed by the new and novel container are consumer desires for a high-integrity but easy to remove container seal that overcomes the prior problems of seal tearing during removal, which necessitated repeated removal attempts. The innovative new container also includes strengthened container elements that can protect against spillage and damage to product due to adverse pressure differentials between the sealed product container and the external environment.

In one preferred configuration of the invention, a sealable container includes top, bottom, and side walls that define interior and exterior surfaces and which enclose an interior space. The walls can preferably have an upper finish portion near an upper end of the walls that defines a sealing flange, which extends to an internal edge that defines an opening to the interior space of the container. The sealable container also incorporates a collar having an interior surface that receives and is captured about the upper finish portion. When so captured, the interior surface of the collar and the exterior surface of the finish portion of the container cooperate to define a subcollar space.

The top wall of the preferred sealable container also includes a removable lid that is pivotally or hingedly attached to the collar and which has an interior surface that, when the lid is in a closed position, covers and seals the opening of the interior space of the container. The lid preferably has a sealing wall that depends from the surface of the lid and projects toward and rests or engages against the sealing flange of the collar. More preferably, the sealing wall is dimensioned or sized to rest against, engage, and or remain inward of the sealing flange when the lid is closed. In variations of any of the embodiments of the invention, the sealing wall of the lid can be used alone and in place of contemplated integral or flexible gaskets, and may also be used in combination therewith.

Even more preferably, the container includes in certain optionally preferred embodiments either an integrally formed gasket carried from the collar and or a separately formed flexible gasket, either of which are preferably configured and dimensioned to flexibly rest against the sealing flange. The gasket can be carried from a surface of the container such as the interior surface of the collar, the interior surface of the walls, or the sealing wall of the lid, as well as combinations thereof and wherein more than one gasket may be preferred for use. When the lid is in the closed position, the gasket, the sealing wall and the sealing flange are arranged and dimensioned so that the sealing wall biases the flexible gasket against the internal edge of the sealing flange. The preferably optional arrangements seal the subcollar space from the container interior to prevent the contents of the container from spilling into the subcollar space.

In variations of these embodiments, the sealable container may also incorporate a modified collar that includes a raised seat or similar feature that carries the flexible gasket or to which the gasket is affixed. As with other versions of the invention, the raised seat is configured so that that gasket projects inwardly to flexibly bias against and to extend beyond the internal edge of the sealing flange, which also serves to control spillage of the contents of the container by directing contents into the interior space. More preferably, the gasket can be arranged to remain biased against the sealing flange when the lid is in an open position.

In additionally preferred and optional embodiments of the invention, the sealable container can also include a removable seal that is substantially impervious to air, water, and or light. The impervious seal preferably extends across the opening to seal the interior space and attaches to the sealing flange. In variations where the flexible gasket is included, the impervious seal preferably is positioned beneath the gasket. The flexible gasket flexes to enable and during removal of the removable seal and thereafter flexes back to rest against the sealing flange and seal the subcollar space.

Even more preferably, the seal is a removable, stability enhanced and or controlled seal that includes new and novel features that minimize manufacturing material costs, improve manufacturability of joining the seal to the sealing flange, and greatly increase the convenience with which users and consumers may remove the seal to gain access to the product contained in the container.

In past attempts to improve seal joining and removability technology, stability controlling features were incorporated that improved rigidity and that increased the integrity of the seal when joined to the sealing flange. Despite such improvements, a need persists to further reduce manufacturing costs by minimizing the amount of material needed to fabricate the seal. Further, consumers and users continued to seek further improvements that maintained a high-quality seal during transit to the marketplace, but which also further improved the peelability and capability to remove the seal from the container.

With these considerations in mind, further innovative investigations revealed a new approach that offered decreased material costs, simplified and reduced manufacturing time, further improvements to the stability controlled capability of the seal, and greatly increased ease of peelability. In the past, the seal incorporated a periphery that included formation of what is termed an embossed registration periphery. The registration periphery was used to align the seal about the sealing flange of the container prior to sealing. While it was known that the registration periphery required more material than would otherwise be needed, it was also believed to be needed to impart rigidity improvements that augment the desired stability control capability of the seal.

However, in evaluating the consumer and user preferences for improved peelability, it was unexpectedly discovered that the structural rigidity capability imparted by the registration periphery impeded peelability due to the frictional force that results when the seal, including the additional registration periphery, is pulled away from the sealing flange. The additional material of the registration periphery must be pulled from between and with enough force to overcome the friction due to the flexible gasket resting against the sealing flange.

The elastomeric flexible gasket imparts a sliding frictional force against a surface of the peeling seal that often caused the seal to tear during removal. The user must then endure the inconvenience of a re-attempt to remove the torn portion of the seal that may remain joined to the sealing flange to gain unimpeded access to the product container in the interior space.

Despite the belief that the registration periphery was needed to improve the structural rigidity of the seal and to enable registration of the seal with the sealing flange during joining, a series of experiments unexpectedly established that removal of the seal was drastically improved when the registration periphery was removed. Further, it was also unexpectedly discovered that the registration capability could be imparted with an interiorly disposed registration embossment that would also serve to replace the structural rigidity enhancement of the removed embossed registration periphery. In fact, further inquiry revealed that the interiorly and peripherally disposed registration embossment offered greater structural rigidity than the former variation.

In most embodiments of the inventive container, the lid is openable and rotatably, hingedly, and or pivotally connected as or to the top wall of the container with a live or mechanical hinge mounted between the lid and the collar so that the lid can move between open and closed positions. In certain preferred configurations of the invention, the novel sealable container is arranged wherein its walls form the container to have an approximately cuboid shape. However, the present invention is susceptible for use in cylindrical, rectilinear, obloid, and many other types of container packaging and for use with all kinds of containerized and flowable substances including fluids as well as powdered and granular materials.

Some modifications of the embodiments of the invention also contemplate inclusion of a removable scoop and a scoop holder that can be attached to or formed about the interior surface of the lid for holding a scoop. The most typical scoops have a bowl that is carried from a handle. The scoop holder of the invention is formed with a first bowl cover bracket and a bowl bottom bracket, and has an minimum material, integrally formed retainer that immobilizes the handle.

In the past, this was accomplished with a separate first projection that extended from the interior surface of the lid and which had a handle holding notch that holds the handle away from the interior surface in a grasping position so that it is easy for a user to grasp and remove the scoop from the scoop holder. However, such past attempts unduly frustrated some consumers as the separate first projection could be subjected to enough force to break away, leaving the scoop holder inoperable. Further, other consumers found the arrangement too difficult to use when it came time to store the scoop in the holder after use.

Consonant with consumer frustrations, manufacturers sought ways to control manufacturing costs by using less polymeric raw materials and by simplifying the manufacturing process. One way to use less material and to speed up and simplify fabrication is to eliminate unneeded elements. With this in mind, the first projection was abandoned in favor of a scoop capture element or latch formed integrally with either the scoop cover or bowl brackets.

Unexpectedly, consumers also found this approach to be far easier to use, more preferable over prior scoop holders, and much less susceptible to breakage during use and operation. The single element or integrally formed scoop capture element can take the form of either or both of a capture latch, which can engage one or more portions of the scoop, or other type of capture element. Another such type of capture element can be a retainer bump that can depend from an extent of the brackets in a way that enables the scoop to be held in place for storage, removed, and returned after use.

In still other variations of any of the embodiments of the inventive sealable container, the sealing wall of the lid can be further modified to funnel inwardly toward a lower edge, either by a curved inwardly directed tapering of a lower edge of the sealing wall, or by a inwardly slanted or inclining tapering thereof, or by a combination thereof. In any of these contemplated variations, the lower edge of the sealing wall can be positioned and dimensioned to rest against, bias, and or engage the flexible gasket so as to, in turn, bias and or engage the flexible gasket against the sealing flange. This arrangement can, when the lid is opened and the lower edge is moved away, enable the user to peel away and remove the seal, and reclose the lid after use to re-bias and or re-engage the sealing wall lower edge against the flexible gasket and the sealing flange.

Still other contemplated modifications are suitable for use with all of the modifications, variations, adaptations already described, which include the bottom surface including pressure control features. Such features may reduce deformation of the container, and may be adapted to enable reversible and controlled deformation to relieve stress on the container due to internal pressure being substantially different from an external ambient atmospheric pressure. Such deformations may occur in the ordinary manufacture, filling, sealing, packaging, transportation, and use of the sealable container as it is subjected to pressure changes due to altitude changes and or other types of pressure-related or other crushing forces.

In this adaptation of the preferred embodiments of the invention, the bottom wall or surface includes a pressure control portion. The pressure control portion may be adapted as a pressure differential compensator formed from a series of elements that may flex in response to pressure differentials and return to a nominal position as the pressure equalizes. In this way, the overall shape of the container may be retained and may not permanently deform when subjected to pressure changes.

Additionally, the bottom wall or surface may further incorporate stiffening elements to enable the pressure control position to move while ensuring that a permanent deflection or deformation is prevented. With a combination of pressure responsive and strength and stiffness enhancing elements, the preferred container can better withstand the rigors of changing pressures after sealing of the product contents in the interior space.

In past attempts, the pressure control portion was combined with a stiffener that extended outwards from the exterior surface of the bottom wall. However, despite analytical evaluations and preliminary field tests that predicted success under nearly all environmental conditions, consumers and distributors reported permanent distension and deformation of containers after delivery and or purchase. Accordingly, new attempts were made to find alternative designs that could withstand real-world pressure fluctuations.

While many different designs were evaluated using classical and iterative engineering practices, an unexpected inspiration resulted in a counter-intuitive and very unusual design. Surprisingly, analytical modeling and preliminary field tests revealed that the unusual design approach offered pressure differential performance that substantially exceeded previous designs as well as engineering predictions.

When combined with earlier pressure control portion designs, the new approach resulted in a superior container performance that greatly exceeded prior attempts, and which successfully prevailed against all known field conditions that had previously created adverse issues. The new and novel design approach incorporated at least one stiffening channel that depends from the bottom wall, upward and into the interior space, and which extends across the bottom wall pressure control portion from front to back, or sagittally.

While the location of the sagittal stiffening channel greatly improved the pressure differential performance of the container across a variety of locations about the bottom wall, one particularly effective location for the sagittal stiffening channel was positioned approximately centered about the bottom wall. More specifically, if an imaginary front to back or sagittal center plane was placed so as to separate the container into approximately left and right halves, it was determined that the sagittal stiffening channel would be well-placed to greatly improve pressure differential deformation resistance or performance if the channel was approximately centered about such an imaginary sagittal center plane. Even so, performance results that greatly exceeded previous container designs were identified even when the contemplated sagittal stiffening channel was located off-center or was substantially offset on either side of the imaginary sagittal center plane.

Even further more subtle optionally preferred variations of the sagittal stiffening channel were discovered, which substantially improved the stiffening and strengthening capability of the channel. In one such alternative variation, the sagittal stiffening channel was preferably formed with stiffener walls that were substantially symmetrical and which depending upwardly from the bottom wall and into the interior space of the container.

More preferably, the stiffener walls were asymmetrically formed wherein at least one of the stiffener walls depended upwardly in a substantially vertical direction. In container configurations that included front and rear or back walls joined at their sides by substantially opposing side walls, wherein such walls are generally vertical, the at least one vertically depending stiffener wall would preferably be substantially parallel to one or both of the opposite side walls. The other stiffener wall would not be parallel to the side walls, but would preferably depend into the interior space at a substantially non-vertical or angled direction relative to the at least one vertically depending stiffener wall and opposing side walls.

Even more preferably, the bottom wall of the container can be considered to have a height that may be generally defined as extended from a bottom-most surface of the bottom wall to a point where the bottom wall is joined to or transitions into any one of the front, back, and or opposite side walls. In this arrangement, the sagittal stiffening channel was found to improve substantially the strength and stiffness of the container, and especially the bottom wall thereof, when the height of the sagittal stiffening channel was approximately between 25 and 50 percent of the height of bottom wall.

The height of the sagittal stiffening channel is preferably measured approximately from a bottom most surface of at least one of the stiffening walls to the point where the stiffening walls joined one another at their furthest extent into the interior space. Most preferably, the height of the sagittal stiffening channel is approximately 50 percent of the height of the bottom wall.

After the discovery of the substantial performance improvement offered by the sagittal stiffening channel, experiments were conducted with an additional transverse stiffening channel formed about the bottom wall. This was to investigate whether a generally orthogonally placed stiffening channel may cooperate with the sagittal stiffening channel to further improve the capability of the container to flex to compensate for pressure differentials without experiencing permanent deformation. It was found that an additional stiffening and strength performance enhancing benefit was possible. The various contemplated sagittal and transverse stiffening channels are further described elsewhere herein.

In still other variations of the embodiments of the invention, a sealable container includes a top wall, a bottom wall, a front wall, a rear wall, and substantially opposite first and second side walls. Each of the walls preferably has a substantially rectangular shape. The rectangular shape of each wall enables the container to take on a substantially cuboid shape and to be stored easily on a shelf or counter-top.

The front wall has at least one recess and the rear wall has at least one recess. The at least one recesses of the front and rear walls are preferably adjacent or proximate to either the first or second opposite side walls. The recesses establish a grip feature, which enables the user to manipulate the lid of the container with one hand when the container rests on a flat surface, e.g., a tabletop or a counter top.

These variations, modifications, and alterations of the various preferred and optional embodiments of the inventive container may be used either alone or in combination with one another and with the features and elements already known in the prior art and also herein described. Such embodiments can be better understood by those with relevant skills in the art with reference to the following detailed description of the preferred embodiments and the accompanying figures and drawings.

BRIEF DESCRIPTION OF THE DRAWING(S)

Without limiting the scope of the present invention as claimed below and referring now to the drawings and figures, wherein like reference numerals, and like numerals with primes, across the drawings, figures, and views refer to identical, corresponding, or equivalent elements, methods, components, features, and systems:

FIG. 7 is a partial perspective view of the embodiments of the container shown in FIG. 6 with the collar now removed to show the collar engagement features of the upper portion of the container.

FIG. 8 is a cross-section view of the upper finish and sealing flange of the tub-shaped receptacle of the container of preceding figures, which is taken along section line 8-8 of FIG. 7. The impervious seal has been added to depict the relationship between the seal and the sealing flange.

DETAILED DESCRIPTION OF THE INVENTION

Figure 1:
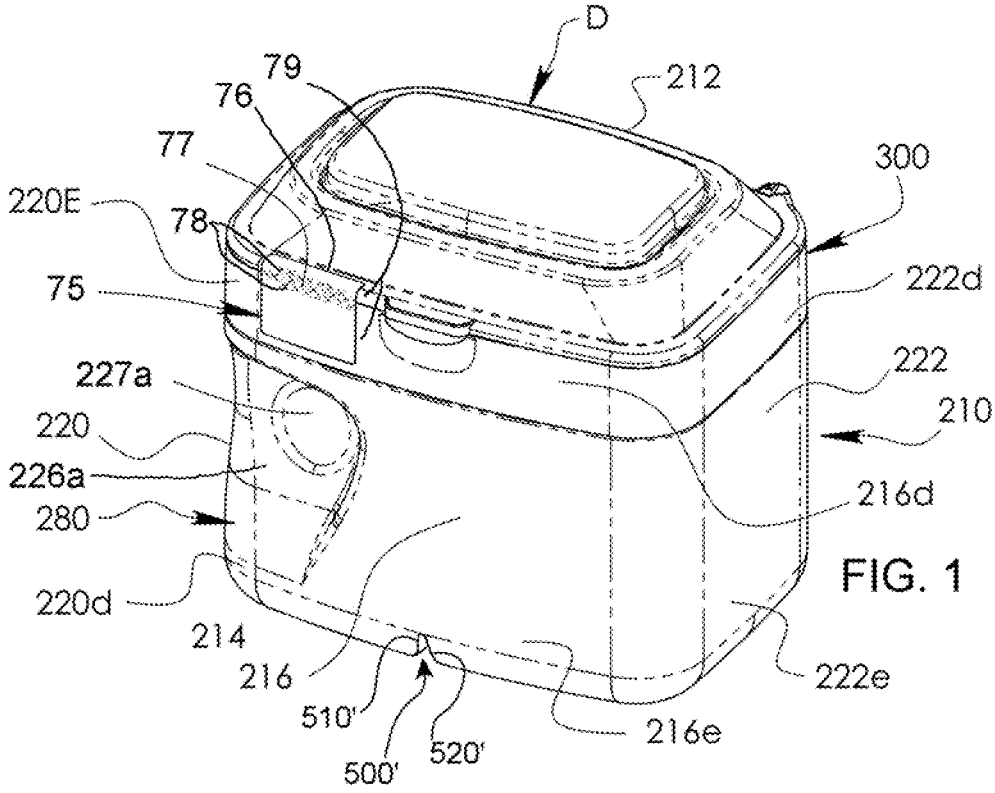
FIG. 1 is a perspective view of the inventive container illustrating a lid that is closed and a side of the container having grip features.

As used herein, the expression "top wall" means the side of the container exclusive of the bottom wall, the first side wall, the second side wall, the front wall, and the rear wall of the container. The term "lid" means a hinged cover for a hollow receptacle and is intended to include either an independently formed and removable lid and other variations that can include the lid alone, the lid and collar assembly, and other variations wherein the lid and or collar are formed from the top wall of the container plus the upper portion of the first side wall, the upper portion of the second side wall, the upper portion of the front wall, and the upper portion of the rear wall of the container. As used herein, the term "bracket" means a wall-anchored fixture adapted to support a load.

With reference to FIGS. 1 through 21, and specifically to FIGS. 1, 2, 3, and 4, a configuration of a sealable container according to the invention is shown and identified generally by reference numeral 210. The sealing container 210 includes a top wall 212, a bottom wall 214, a front wall 216, a rear wall 218, a first side wall 220, and a second side wall 222, which together define an interior space "I". The walls are defined with interior and exterior surfaces denoted generally in the various figures by a suffix "a" for interior surfaces and "b" for exterior surfaces. Upper and lower portions of the walls are generally denoted by respective suffixes "d" for upper portions and "e" for lower portions.

The front wall 216 includes an interior surface 216*a*, an exterior surface 216*b*, an upper portion 216*d*, and a lower portion 216*e*. The rear wall 218 has an interior surface 218*a*, an exterior surface 218*b*, an upper portion 218*d*, and a lower portion 218*e*. The first side wall 220 defines an interior surface 220*a*, an exterior surface 220*b*, an upper portion 220*d*, and a lower portion 220*e*. The second side wall 222 includes an interior surface 222*a*, an exterior surface 222*b*, an upper portion 222*d*, and a lower portion 222*e*.

With reference now also to FIGS. 5 through 16, it may be understood that a top wall lid 212 of the container 210 may be a separate component, part of an assembly, and may also include and be formed as a part of the top wall 212 and the upper portion 216*d* of the front wall 216, the upper portion 218*d* of the rear wall 218, the upper portion 220*d* of the first side wall 220, and the upper portion 222*d* of the second side wall 222.

An alternative, preferred configuration of the lid depicted here is referred to generally by reference character "D", to represent a "domed" type lid. The lid "D" has an interior surface, hereinafter referred to by reference character "$D_i$". The lid D also has an exterior surface, hereinafter designated by reference character "$D_e$". The exterior portion $D_i$ of the lid "D" may also be shaped to cooperate with the features of the exterior surface bottom wall 214 to enable stacking of the containers 210.

As contemplated for use with this and the other previously and later described embodiments of the invention, the lid "D" is shown as a separate component that is hingedly, rotatably, and or pivotally connected to the container 210. Even more preferably, the lid "D" may be connected to a later described collar for incorporation into the variations of the embodiments of the invention.

An alternative hinge 224 may attach the lid "D" to the upper portion 218*d* of the rear wall 218. While any of various types of hinges may be incorporated in the embodiment contemplated by sealing container 210, the modified mechanical hinge 224 as shown in the various figures may be incorporated to replace or work in combination with any of a number of differently configured types of hinges.

Figure 2:
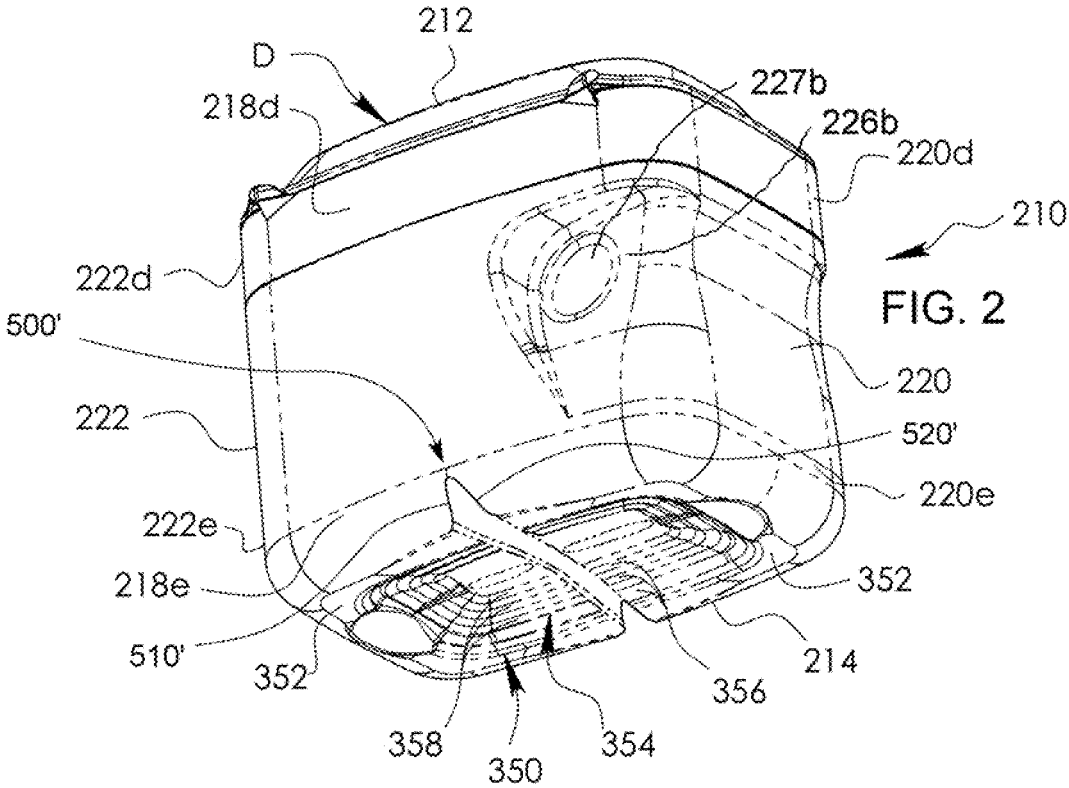
FIG. 2 is a perspective view of the embodiment of the container of FIG. 1, and rotated to show rear and bottom sides of the container.
Figure 4:
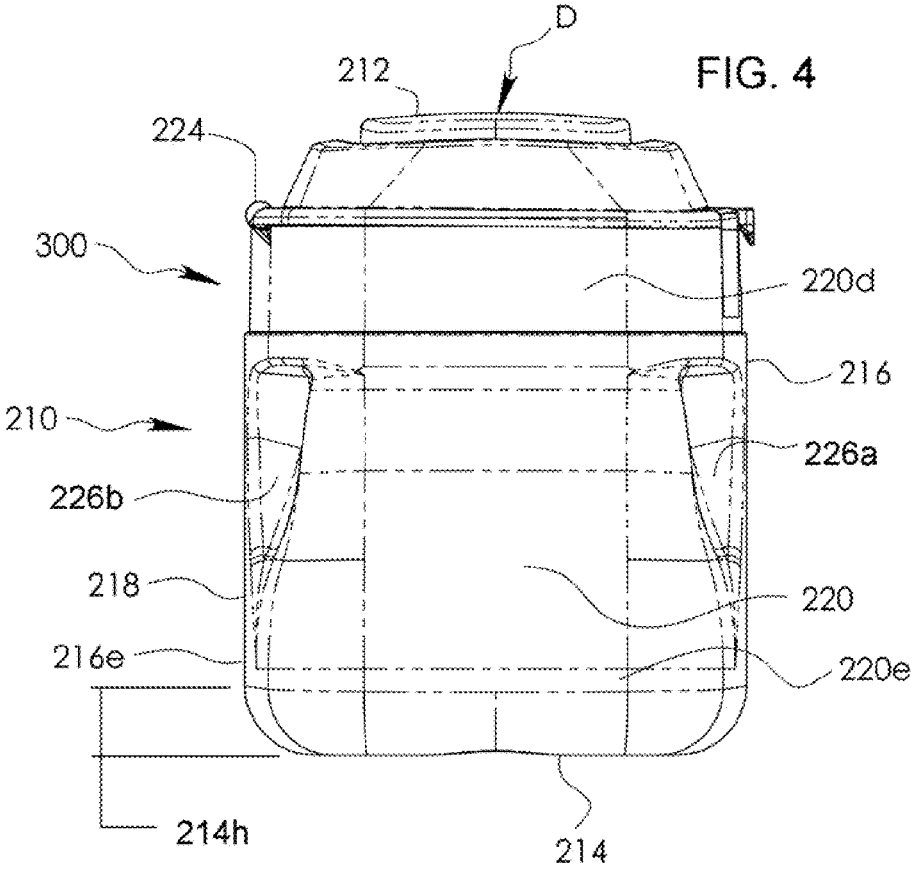
FIG. 4 is an elevation view of a first side wall of the embodiment of the container of the preceding figures and depicting front and rear gripping features.

The modified variations of the sealing container 210 may also incorporate gripping features 226*a*, 226*b* (FIG. 4) as shown in FIGS. 1, 2, 4, wherein the front wall 216 has a recess 226*a* arranged to enable grasping or gripping of the container 210 by a left thumb of the user. The rear wall 218 also has a recess 226*b* positioned to facilitate gripping of the container 210 by the fingers of the left hand of the user. The recesses 226*a*, 226*b* can further have additional recesses 227*a*, 227*b* (FIGS. 1, 2) to indicate the precise location in the recesses 226*a*, 226*b* for the placement of the thumb of the user. The recesses 227*a*, 227*b* are preferably smaller in area than the recesses 226*a*, 226*b*. In FIGS. 1, 2, 4, the recesses 226*a* and 226*b* are positioned adjacent to the first side wall 220 of the container 210. However, variations (not shown) will incorporate the recesses to be complemented by additional and or replacement recesses proximate the opposite second side 222 for use by the other hand of the user.

With reference now also to FIGS. 5, 6, 8, 10, 11, and 19-21, the container includes a substantially moisture-impervious, oxygen-impervious seal 28 having a pull tab 28*a* is affixed to a position proximate to edges of the upper portions 216*d*, 218*d*, 220*d*, 222*d* of the walls 216, 218, 220, 222. The substantially moisture-impervious, oxygen-impervious seal 28 may optionally, also be impervious to light. A pull-tab 28*a* on the substantially moisture-impervious, oxygen-impervious seal 28 can be used to facilitate peeling and removal of the seal 28 by the user.

The substantially moisture-impervious, oxygen-impervious seal 28 can be formed from a sheet of material substantially impervious to oxygen, moisture, and or light. A material suitable for use in preparing the substantially moisture-impervious, oxygen-impervious seal 28 can be a sheet of foil, such as, for example, aluminum foil, or a foil made of some other metallic material, or a combination of a layer of materials that can include a metallic, a polymeric, and other material layers.

Figure 14A:
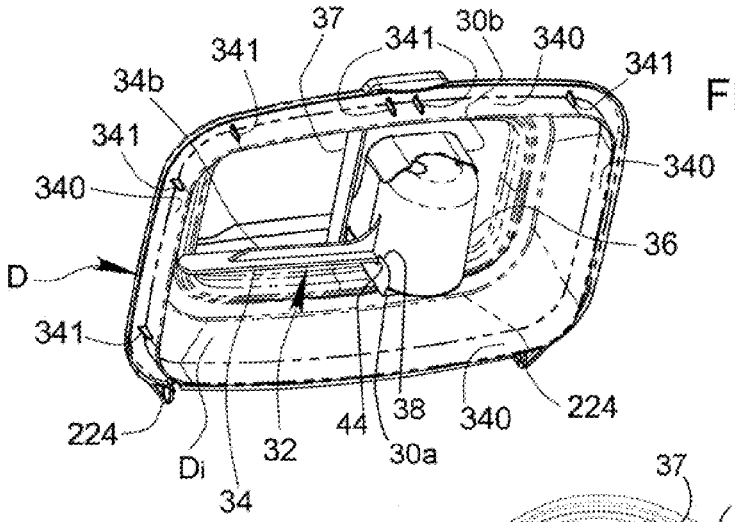
FIGS. 14A and 14B are perspective views of the underside of the lid of the container of FIGS. 1-4 and illustrating a scoop holder retaining a scoop and again without the scoop.
Figure 14B:
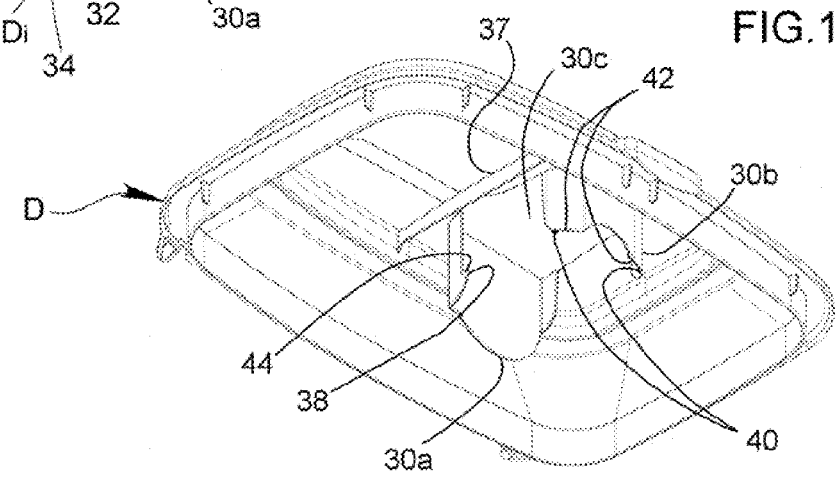
Figure 15:
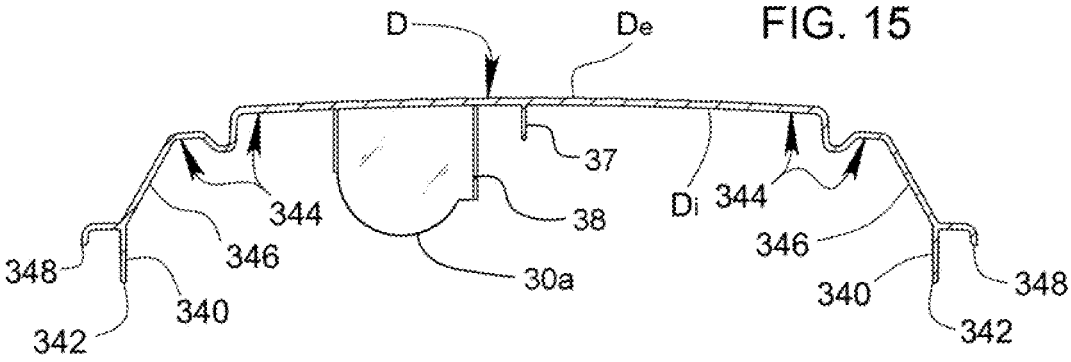
FIG. 15 is a section view of the lid of the container of FIG. 13 and taken along section line 15-15 to show a laterally extending cross section of the lid.
Figure 16A:
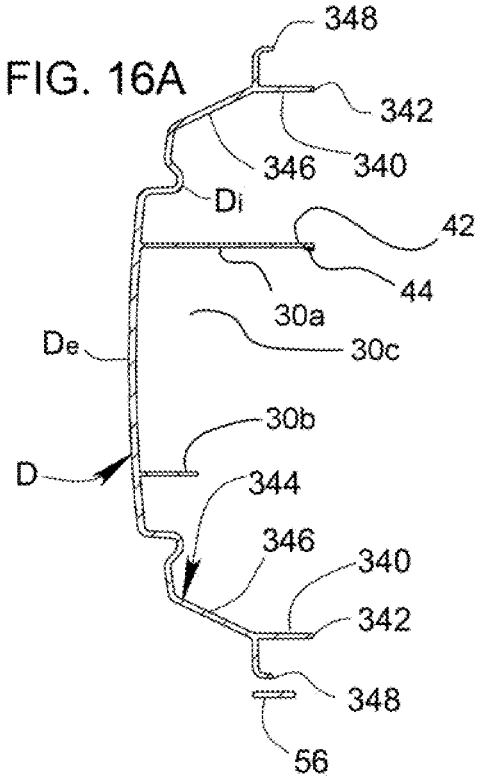
FIG. 16A is a section view of the lid of the embodiment of the container of FIG. 13 and taken along section line 16A-16A with a view directed towards the retainer element of the scoop holder or bracket.
Figure 16B:
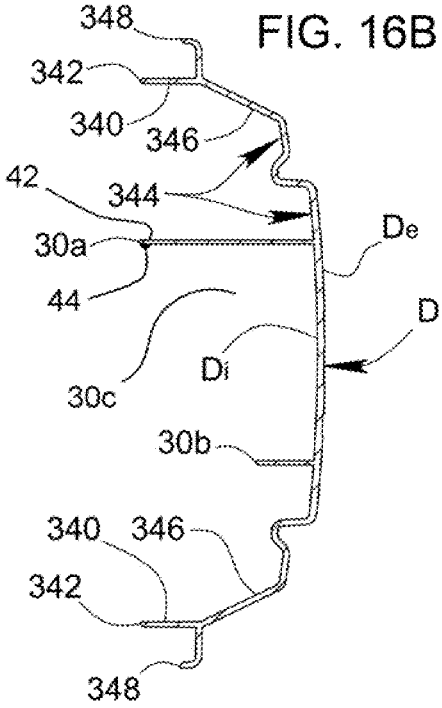
FIG. 16B is a section view of the lid of the embodiment of the container of FIG. 13 and taken along section line 16B-16B with a view directed towards other portions of the scoop holder bowl brackets.

Referring now to FIGS. 14 through 16, attached to or formed about the interior surface "$D_i$" of the lid "D" is a scoop holder 30 adapted to receive a scoop 32. The scoop 32 may include a stiffened handle 34 having a stiffener 34*b* integrally formed thereon and a bowl 36. The scoop holder 30 preferably includes a first scoop cover bracket 30*a* substantially opposite a second bowl bracket 30*b* defining a scoop holder recess 30*c* there between and dimensioned to be biased against and cover and hold the bowl 36 in a friction fit arrangement when the scoop 32 is inserted into the holder 30. Although shown in one alternatively preferred arrangement and orientation, the exemplary illustrations also contemplate similarly optionally preferred configurations wherein the holder may be reversed, mirrored, and or repositioned in a number of possibly equally desirable positions about lid D.

The first scoop cover 30*a* preferably depends outward to a predetermined maximum dimension whereby the respective bowls 36 of differently sized scoops 32 may be covered with a single bowl cover bracket 30*a*. This arrangement can be incorporated to maximize convenience when dispensing different volumes of the contents of the container 210 using appropriately sized scoops 32. The scoop holder 30 retains the scoop 32 in a position to keep the scoop 32 separated from the product contained within the container 210.

When releasably retained in the holder 30, the scoop 32 is positioned in the holder recess 30*c* and is biased against the first scoop cover bracket 30*a* and the second bowl bracket 30*b* to cover the bowl 36 and keep it from accumulating product. This configuration also may encourage the user to remove the scoop 32 by the handle 34, rather than by the bowl 36, which may keep the bowl 36 in a more sanitary condition during use.

Being retained in this way, the bowl 36 of the scoop 32 also does not interfere with substantially moisture-impervious, oxygen-impervious seal 28 when the scoop 32 is positioned in the scoop holder 30. As an additional convenience to the user, a handle rest 37 may also be preferably incorporated that may prevent the handle 34 from coming to rest against the interior surface. This arrangement, in turn, creates a minimum gap between the handle 34 and the interior surface $D_i$ of the lid D, which gap creates a convenient finger grip point for removing and repositioning the scoop 32.

Another optionally preferred and additionally important advantage over prior scoop holder designs is directed to maintaining the integrity of the seal 28, 400 after filling and sealing. As discussed in more detail elsewhere herein, during transit a pressure differential may exist between the pressure of the interior space "I" and the external atmospheric pressure. When this occurs, the seal 28, 400 may flex or tent outwardly in stances where the internal container pressure exceeds the external atmospheric pressure.

Under these conditions, the outwardly tented seal 28, 400, may project far enough out to contact one or more elements of the scoop 32 when it is retained in the holder 30. More specifically, the tented seal 28, 400 might become biased against the handle 34 and or the scoop bowl 36, or other elements thereof. In past configurations of scoop holders, the handle most typically was held in place by a number of handle retaining posts or elements that prevented movement of the handle. In the most likely configuration, the tented seal 28, 400 would then be biased against an edge of the handle for some period of time while the pressure differential persisted and the seal 28, 400 maintained an outwardly projecting, tented configuration. Unable to move or flex with such holder configurations, an undesirably large force may arise between the handle and the seal 28, 400.

In devising the new and improved, minimum material latch 38 that is integrally formed with the scoop cover 30*a* and the handle rest 37, it was also discovered that the handle 34 of the scoop 32, is now enabled to relieve undue biasing forces. This is accomplished as the handle 34 flexes away from the seal 28, 400 and towards the lid interior surface $D_i$ whenever a pressure differential caused the seal 28, 400 to tent outwardly.

After further analysis of the performance of the container under storage, transit, and stacking conditions, it was also discovered that the handle rest 37 could be configured as a stiffener to enable the lid D to withstand substantially greater crush and other forces.

The scoop holder 30 is also configured so that the handle 34 of the scoop 32 is prevented from contacting the substantially moisture-impervious, oxygen-impervious seal 28 positioned over the contents of the container, to protect the integrity of the seal 28. In addition, the scoop holder 30 prevents the handle 34 from being dislodged and maintains the position of the scoop 32 during shipping and storage.

When inserted into the scoop holder 30, the scoop 32 is retained by the first bracket 30*a* and the second bracket 30*b* by means of a friction fit between the brackets 30*a* and 30*b*. The scoop holder 30 has abandoned previous configurations in favor of a minimum material, efficient structure that incorporates a single element or integrally formed scoop capture element into at least one of the scoop cover and bowl brackets 30*a*, 30*b*.

Overcoming the inefficient and more difficult to use designs of previous types of scoop holders, the new and novel scoop holder 30 may integrally incorporate either or both of a capture latch 38 positioned to engage a portion of the handle 34 and a retainer bump 40 that can be formed about extents 42 of the brackets 30*a*, 30*b* (FIGS. 14, 15, 16). The capture latch 38 also preferably includes at least one edge 44 (FIG. 14B) that projects in a direction substantially orthogonal to an imaginary plane formed by the scoop cover 30*a*.

With continued reference to the various figures and specific reference again to FIG. 1, a tamper-indicating seal 75 can be adhered to the front or another place on the container 210 to present evidence of tampering, damage, or opening of the lid D. In FIG. 1, the tamper seal 75 is affixed to wall 216*d* and the lid D of the container 210 to provide a visual indication as to whether the container 210 has been opened. In one embodiment, the tamper-indicating seal 75 incorporates an upper portion 76 that separates from the remainder of the seal 75.

The portion that separates may include a frangible backing or frangible and polymerically laminated foil layer adhered to a layer of adhesive (not shown, but known to those skilled in the relevant arts). The backing can also be a sheet of tearable paper or tearable polymeric material. The adhesive can be a moderately to highly aggressive adhesive. The tamper seal 75 can be positioned in a number of equally effective locations, including for purposes of example without limitation, across the interface between the lids and walls as well as in appropriate locations across the contemplated assemblies of collars and lids.

It is preferred that a score line or a line of perforations 78 be present in the tamper-indicating seal 75 at the line where the lid D meets the upper portion 216*d* of the front wall 216 of the container 210. An attempt the open the container 210 will result in tearing the along the score line or the line of perforation 78, thereby indicating visually an inadvertent or undesired dislodgement of the lid D from a collar 300, or an unauthorized attempt to open or an actual opening of the container 210.

Preferably, the seal 75 incorporates an upper portion 76 that may be separated from the remainder of the seal 75 about a frangible portion 77 that is formed to have a predetermined cross section. The predetermined cross section may preferably depend upon the geometry and dimensional configuration of the container. The predetermined cross section may also preferably or optionally depend upon the likely force that the seal 75 will encounter as the lid D is dislodged or separated from the collar 300.

In one optionally preferred arrangement of the container 210, collar 300, and lid D that may be subjected to the force induced by human fingers separating the lid D from the collar 300, the seal 75 may be formed from a foil laminated with a polymeric material to have a thickness of between about 1 and 10 mils (about 0.001" to 0.010"), or more preferably between about 1.5 mils and 6 mils, and even more preferably between about 2.0 mils and 4.0 mils. The contemplated seal 75 may also be formed with the predetermined cross section ranging approximately between 0.50" and 1.0", and more preferably between about 0.75" and 0.9", and even more preferably about 0.88".

In yet other optional or preferably variations of the seal 75, the upper portion 76 and the remainder of the seal 75 adjacent to the frangible portion 77 may incorporate a cross section that is substantially the same as or larger or smaller than that of the frangible portion 77. Even more preferably, the upper portion 76 and remainder of the seal 75 may be substantially larger in cross section relative to the frangible portion 77 so as to enable a greater surface area of adhesive to adhere to an adhesion promotion area or control region 79, which is described in more detail elsewhere herein.

In one contemplated modification to any of the embodiments of the proposed seal 75, the cross section of the upper portion 76 and remainder of the seal adjacent to the frangible portion 77 was formed to be approximately between 0.9" and 2.0", and more preferably between about 1.0" and 1.75", and even more preferably approximately 1.3".

In other possibly desirable alternative configurations of the tamper seal 75, the contemplated scoring or perforations 78 may also incorporate a cross hatched or what is sometimes referred to as a "herring bone" pattern. One such possibly preferred cross hatch perforation or scoring pattern is illustrated in FIG. 1.

Either alone or in combination with the predetermined cross section of the frangible portion 77, the cross hatch perforation pattern 78 may be incorporated to precisely establish the shear or tensile force that can be withstood by the frangible portion 77. In other words, a precise, predetermined and net or effective cross sectional area of the frangible portion may establish a precision separation force control capability unavailable with prior devices. Such a precise cross sectional area may be incorporated when and if preferred so as to ensure that any dislodgement or separation force over some preferred amount that is imposed between the lid D and the collar 300 will cause the upper portion 76 of the seal 75 to separate from the remainder of the seal 75.

More preferably or optionally, the seal 75 is attached to a specially treated area of any of the variations of the collar and lid, which has been treated to increase the surface energy thereof, which in turn improves the adhesion characteristics. The contemplated specially treated area may be termed an adhesion promotion area or adhesion control region 79.

Enhancing the adhesion capabilities of the region 79 is of particular interest to the instant application because improved adhesion capabilities enable use of a dimensionally smaller seal 75, which can improve aesthetics. Additionally, of special importance to the embodiments of the invention where a tamper seal 75 may be incorporated, the unusual geometries and dimensional arrangements of the container 210 may result in smaller surface areas being available for application of the seal 75. The contemplated adhesion control region 79 is optionally or preferably established by increasing the surface tension or energy of the polymeric material about and proximate to adhesion control region 79. A wide variety of such treatments are available and generally known to those having skill in the relevant arts.

Most often, such treatments will optionally or preferably include plasma, flame, or corona discharge treatments, chemically treating or coating the region 79 with an adhesion promoting acrylic substance, and or coating the region 79 with an adhesion promoting chemical. One or more such treatments may be used separately, sequentially, and or in combination with one another to obtain the desired level of improved adhesion capability of the adhesion control region 79.

In another preferred or optional variation to any of the preceding embodiments, the container 210 may be formed as a tub-shaped receptacle 280 similar in construction to earlier described embodiments but may also incorporate upper portions 216*d*, 218*d*, 220*d*, 222*d* of walls 216, 218, 220, 222 having an upper end 282. The upper end 282 defines a sealing flange 284 having an internal edge 286 that defines an opening to the interior space "I".

In further preferred arrangements, the impervious seal 28 is seated around the upper end 282 to close and seal the opening and is peelably and removably affixed to the sealing flange 284. To improve accuracy and convenience during assembly and placement of the impervious seal 28 on the sealing flange 284, an optional snap bead 288 (FIGS. 8 & 11) may be formed on the upper end 282 below the sealing flange 284.

Such a snap bead 288 can be used as a shelf and or seat that contacts the edges of the unattached impervious seal around the periphery of the container to keep the impervious seal 28 in place and centered so that it can be attached with adhesive, heat sealing, and combinations thereof and or another means.

In the past, many containers were improperly sealed due to incorrect placement of the seal before a joining and or an adhesion step glues, melts, or otherwise affixes and joins the impervious seal 28 to the sealing flange 284. Additional variations of any of the embodiments of the invention may also include assembly improving features such as one or more engagement recesses or indentations 290 defined laterally separated by strengthening bridges 292, a lower seat rib 294, and an upper lug ledge or downwardly facing top surface 296.

The spaced apart bridge 292 arrangement imparts improved strength and rigidity capabilities to the upper end 282 of the receptacle 280, which, in turn, improves the crippling strength of the container and the rigidity of the upper end 282 when the collar 300 is fitted together with the receptacle 280. Further preferred or optional variations to any of the preceding embodiments may include a modified collar 300 that can be best understood with specific reference to FIGS. 1-6 and 9-12. The collar 300 may be formed with a substantially J-shaped and or U-shaped cross-sectional configuration. With reference to the various figures, it can be seen that the exemplary collar 300 has an upside-down u-shape and or j-shape.

The collar 300 includes an exteriorly or outwardly facing long wall 302 that extends upward to join a substantially rounded portion 304 that may have an increased thickness if needed for stiffening the collar 300. The small relative radius of the J-shaped section shown in the illustrations enables excellent stress distribution and force load path communication by way of a higher cross-sectional moment of inertia, which results in a stiffened and stronger collar. The long wall 302 also forms a part of the upper portions 216*d*, 218*d*, 220*d*, 222*d* of the walls 216, 218, 220, 222.

The rounded portion 304 extends further and downwardly to form an interiorly or inwardly facing short wall 306. More preferably, the rounded portion 304 will be formed to have a lip seat 305 that enables alignment and improved engagement of the outermost edge 348 of lid "D" when it is closed onto the collar 300.

The collar may also preferably incorporate engagement lugs or flex clips 310 that are laterally spaced apart to correspond to the lateral spacing of the indentations 290. The flex clips 310 will incorporate an upwardly facing surface and or a retainer face 312 and may also optionally include a stiffening rib 314. During assembly, the collar 300 will be centered and aligned by the flex clips 310 and thus arranged to fit on, overcap, and or be installed upon the upper end 282 of the tub-shaped receptacle 280 so that the flex clips 310 will bend outwardly slightly as the collar 300 descends over the upper end 282.

Once the flex clips 310 are moved into a juxtaposition relationship with the indentations 290, the flex clips 310 return to the nominal orientation and snap into position so that the retainer faces 312 contact the downwardly facing top surfaces 296 to interlock the collar 300 onto the receptacle 280. In this way, the collar 300 is captured and in a friction-fit and flex clip 310 engaged relationship with the tub-shaped receptacle 280. A bottom end 303 (FIG. 11) of the outwardly facing long wall 302 will generally come into contact with and rest against the lower seat rib 294 of the receptacle 280, which in combination with the other features of the invention enables increased strength and rigidity.

The laterally spaced apart indentations 290 and bridges 292 establish a well-distributed load interface between the collar 300 and the receptacle 280 having good rigidity properties when subjected to nominal applications. Additionally, the laterally spaced apart bridges 292 have been found to greatly improve the crippling strength of the assembled collar 310 and receptacle 280 combination. These features combine with the capture and retain capability of the flex clips 310 to hold the collar 300 to the upper portion or upper end 282 of the container 210 and thereby laterally stabilize the collar 300 so that the collar 300 remains in a substantially fixed position relative to the container opening.

In additionally preferred and optional modifications to any of the embodiments of the invention, the plurality of indentations 292 and the plurality of spaced apart flex clips 310 are further positioned to be oppositely paired across the receptacle 280 to establish force load coupling between the pairs to increase rigidity and structural stability of the sealable container 210 when the collar 300 is fitted onto the upper end or portion 282. This opposite or confronted pairing establishes a series of coupled moment arm vectors having a distance equal to the diameter, width, and or depth dimension of the container, which greatly improves load distribution across the container 210 and increase the structural stability thereof.

Furthermore, it has been found that these novel features have resulted in an unexpected configuration that overcomes otherwise unacceptable tolerance anomalies and part mismatch between the collar 300 and the upper portion or upper end 282 of the receptacle 280, which greatly reduces rejected parts and which significantly lowers manufacturing costs. More specifically, it is optionally preferred to incorporate the upwardly facing surfaces or retainer lugs 312 to be dimensionally smaller than the downwardly facing surfaces or upper lug ledges 296 of the receptacle 280.

In one aspect, this dimensional arrangement can enable the retainer lugs or upwardly facing surfaces 312 to move within the engagement recesses or indentations 290 and about the upper lug ledges or downwardly facing surfaces 296. This can enable the combination of these components to absorb dimensional tolerance errors and enable the collar to fit around the upper portion of the container. Even more preferably, at least one of the collar 300 and the upper end or portion of the walls 282 are formed from a substantially flexible material such as a polymeric material like polyethylene or polypropylene to enable at least one of the collar and the upper portion of the walls to flex.

Flexibility enables absorption of dimensional tolerance errors, which enables the collar to fit around the upper portion of the container. Also, this can enable at least one of the collar 300 and the upper portion or end 282 of the walls to flex to accommodate shape mismatch between at least one of the collar and the upper portion of the walls to enable the collar to fit around the upper portion of the walls.

In other preferable or optional arrangements, the collar 300 may also further incorporate one or more alignment recesses 316 (FIG. 9) that may enable faster and more accurate installation, molding, and or affixing of a gasket or other component as described elsewhere herein. Such a gasket alignment recess can additional value during various types of manufacturing or fabrication processes as can be better understood in connection with the following discussion of such gaskets.

Figure 11:
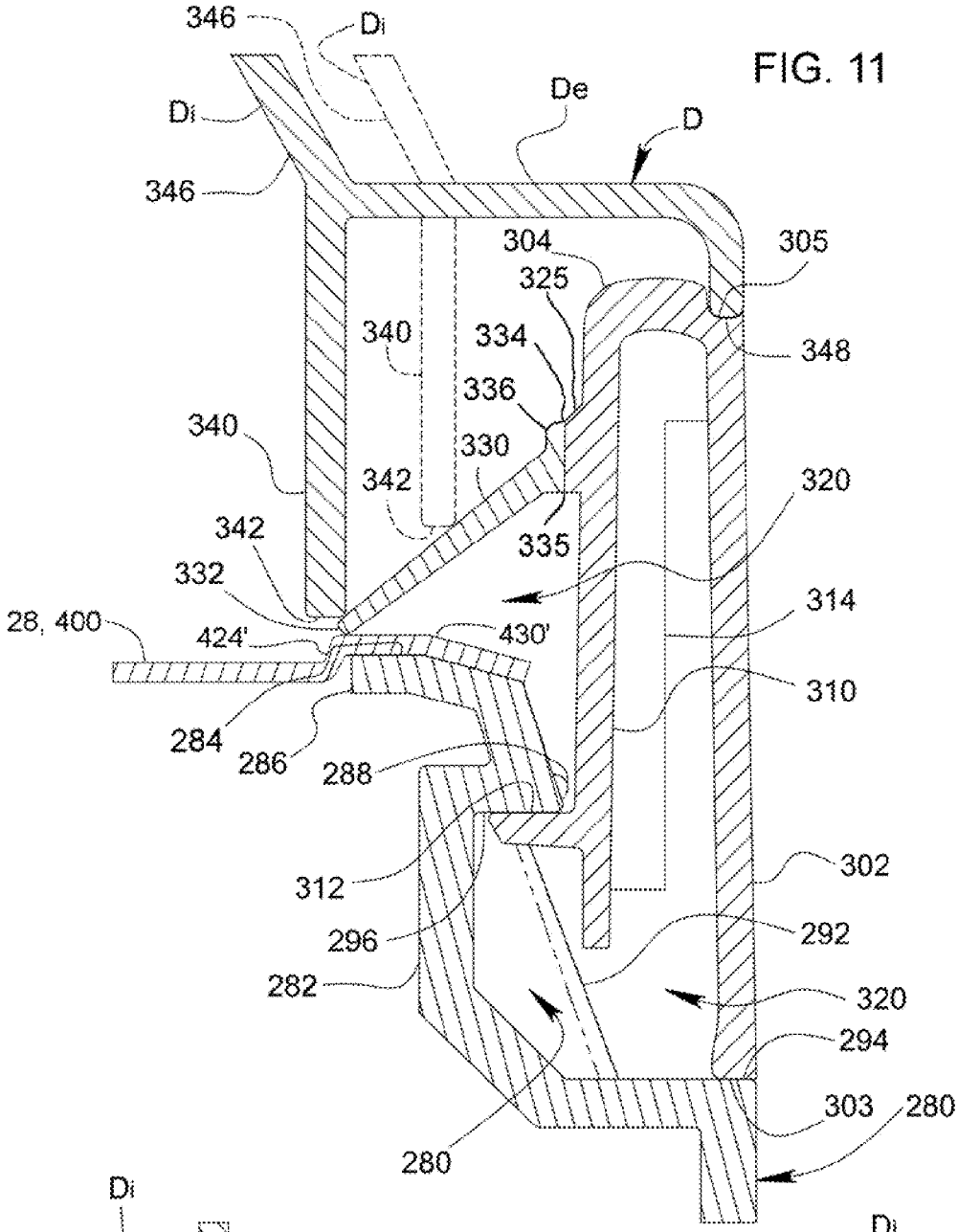
FIG. 11 is a cross-section view of the collar shown in FIG. 5 and taken about section line 10-10 of FIG. 9, and having certain structure shown or removed for illustration purposes.

When assembled, the collar 310 and the upper end 282 of the receptacle 280 form a subcollar space 320 (FIG. 11). In other optionally preferred arrangements of the collar 300, a raised seat 325 may be formed on the inwardly facing short wall 306 to establish a greater thickness of the short wall 306 for applications where other elements may be attached to the short wall. In one particularly preferred optional embodiment, a flexible, polymeric gasket or seal 330 may be affixed to the short wall 306, and more preferably may be attached to the raised seat 325.

Even more preferably, the flexible gasket 330 may be either affixed by adhesive to the short wall 306 and or the raised step 325, may be directly injection molded onto the short wall 306 and or the raised step 325, or may be inserted in a pre-molded form using an alignment tab 334 (FIG. 5) and then be melted, glued, or affixed with a combination of such means.

In this particular example, the raised seat 325 may be also thermoformed as the collar 310 is formed or molded, or the raised seat 325 may be formed in a second and or separate thermoforming step that may occur before the gasket 330 is attached. Additionally, the raised seat 325 may be formed in the step at the same time or nearly the same time the gasket 330 is attached. The flexible gasket 330 preferably extends inwardly and interiorly with an internal edge 332.

Preferably, the flexible gasket 330 is dimensioned to project inwardly or interiorly and to removably rest against the sealing flange 284 as depicted in FIGS. 8 and 11. More preferably, the flexible gasket 330 projects slightly downwardly to be biased against the sealing flange 284 for an improved sealing configuration. Even more preferably, the flexible gasket 330 extends interiorly or inwardly to project the internal edge 332 beyond the internal edge 286 of the sealing flange 284. With this arrangement, the subcollar space 320 is sealed from the interior space "I" to prevent contents of the interior space "I" from entering the subcollar space 320. If such is not prevented, an inconvenience results wherein contents that have spilled into the subcollar space 320 may further spill outside the container 210 by moving through any interstice that may exist between the lower end of the outwardly facing long wall 302 and the lower seat rib 294 (FIG. 11).

Figure 5:
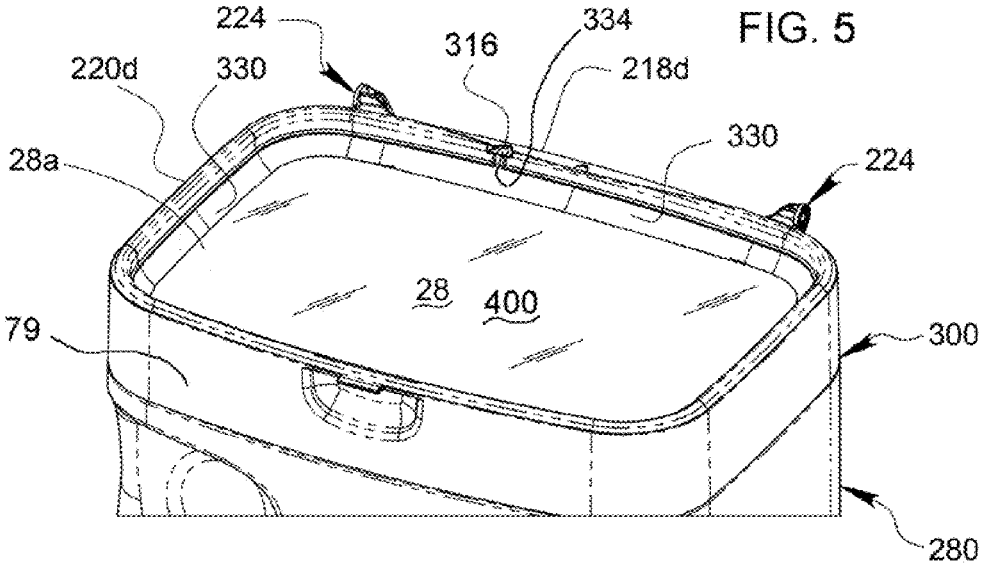
FIG. 5 is a partial perspective view of the embodiment of the container of the preceding figures having the lid removed so as to show the collar and the arrangement of the impervious seal affixed and covering the opening of the container.
Figure 6:
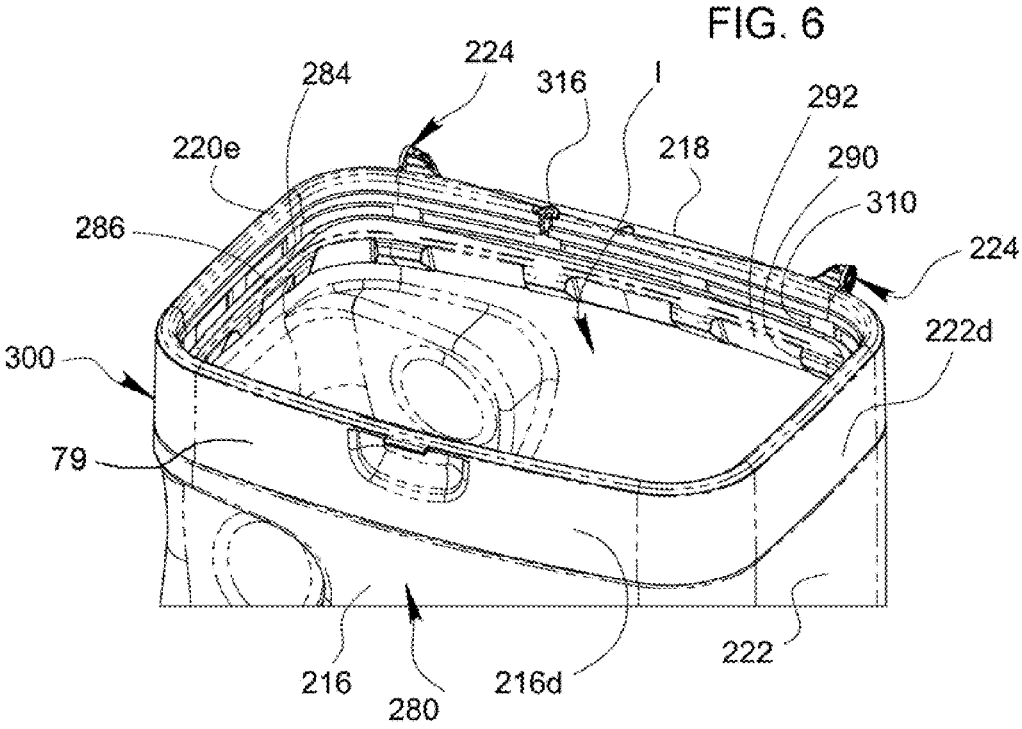
FIG. 6 is another partial perspective view of the embodiment of the container of FIG. 5 further showing the gasket and impervious seal removed to illustrate the collar as it is retained on the container.
Figure 9:
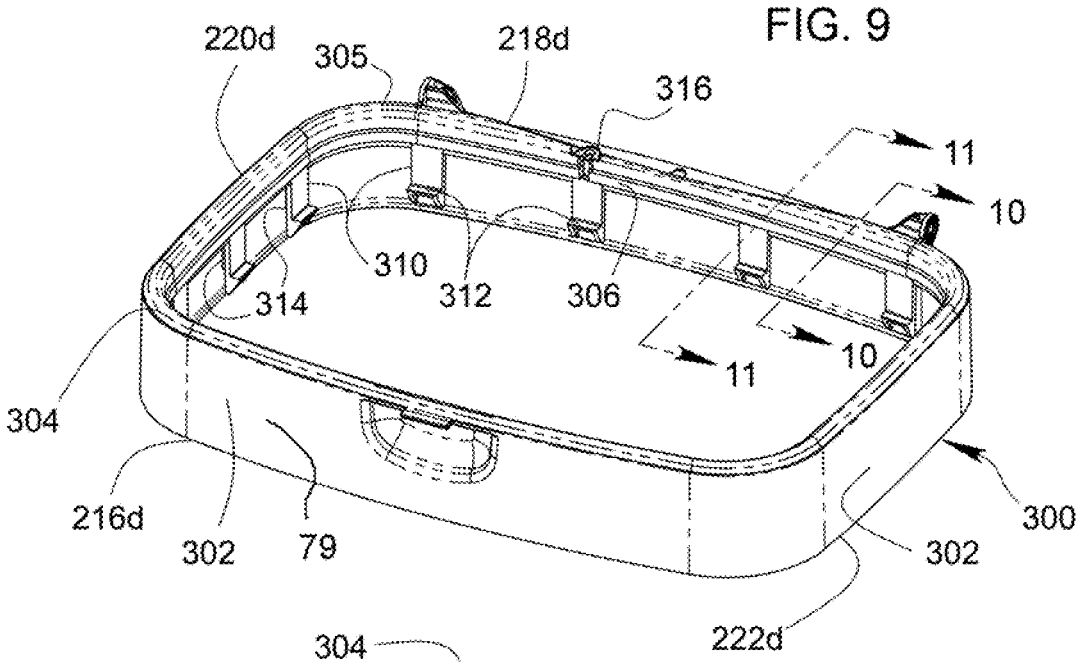
FIG. 9 is a perspective view of the collar of the container of previous illustrations.

With specific reference to FIGS. 5, 9, and 11, those skilled in the art may comprehend that the impervious seal 28 is removably sandwiched between the gasket 330 and the sealing flange 284 (and beneath the gasket 330). When pull tab 28*a* is grasped and the impervious seal 28 is removed to expose the contents of the container 210, the flexible gasket 330 flexes away from its rest position against the sealing flange 284 to enable removal of the impervious seal 28. As the impervious seal 28 is removed, the flexible gasket 330 returns to its rest position against the sealing flange 284.

Many possible types of material are suitable for use in fabricating the gasket 330. One illustrative example of a suitable material includes a thin polymeric material such as a thermo-plastic elastomer having a durometer strength of approximately 50 or other similar Shore A grade material so that the impervious seal 28 may be easily removed while the flexible gasket is still able to retain some shape memory so that it returns to a biased, sealing, at rest position against the sealing flange 284. For optionally preferred applications, Shore A grade material such as a Santoprene and similar compounds have been found to be satisfactory and can be readily thermoformed or injection molded directly onto the inwardly facing short wall 306 and or the raised seat 325.

In other equally preferred and optional variations to any of the embodiments of the invention, the gasket 330 may be integrally formed as part of the collar 300 wherein the gasket 330 is a flap of flexible and thin material that is molded from and that extends from the interior surface of the collar 300. In this contemplated modification to any of the embodiments, among other options, the raised seat 325 can be formed to project inwardly as the gasket 330.

In still other and additionally optional or preferred arrangements, the gasket 330 may incorporate a number of further capabilities that can improve installation and operation of the gasket 330. In some past efforts to injection mold or melt the gasket 330 onto the raised seat 325, an anomaly can occur, which is termed as leakage, flash, or flashing by those skilled in the arts. In the context of the instant invention, flashing of the gasket 330 may sometimes occur for low durometer materials that may have a tendency to leak from seams between the mold cavities when such a gasket is injection molded into place upon the collar of the container 210.

Figure 10:
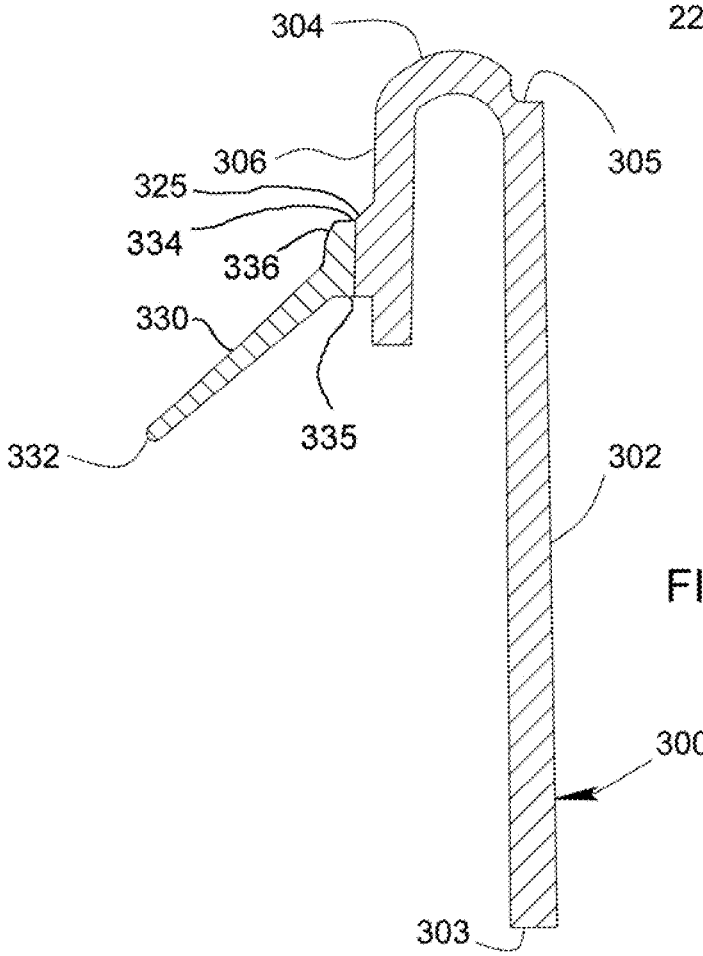
FIG. 10 is a cross-section view of the collar shown in FIG. 9 and taken along section line 9-9 to illustrate the flexible gasket at rest and in a deflected orientation

Such leakage or flashing creates post molding debris most often about the mold cavity seam lines. In other words, after fabrication, loose and easily separable wisps of flash material may come loose or fall off and contaminate the container and surrounding areas. In this application, such flashing or leakage of the molten polymeric gasket material may be seen proximate to the internal edge 332 (FIGS. 10-11). Flash or flashing may also be seen proximate to the upper and lower joints 335, 336 (FIGS. 10-11) of the gasket 330 with the raised seat 325.

In some cases, flash can be avoided by using lower molding pressures or by using slower injection flow rates, or by using far more expensive mold cavities that better seal the area where the gasket 330 is to be injection molded, and by combinations thereof. However, beside the implicit cost increase, the more expensive mold cavities that may offer better sealing, often require higher pressures and slower flow rates, which slows manufacturing. Even such more expensive mold cavities wear over time and may lose their improved sealing capability rendering the added cost undesirable.

Attempts to solve such flash problems have in the past required a sacrifice in the speed of the manufacturing process, which increases the cost to produce each gasket 330. In one contemplated and particularly desirable configuration, it was discovered that a higher flow rate could be maintained at a lower pressure that avoided the flash problem wherein the gasket 330 was modified to incorporate a substantially circumferential or circumfluent flow management bead, conduit, channel, path, or pad 336. In attempts to achieve success in designing and fabricating a suitable pressure reducing or mold melt flow management conduit or bead 336, a number of other unexpected but highly desirable capabilities where discovered.

One such capability that was observed is that the pressure and flow control path or pad 336 also functioned as a root strengthening feature for the gasket 330 that acted as a stress distribution boss, load distributor, gasket deflection or flexure pad 336, and also as a shape memory retention improvement feature 336 of the gasket 330. Repeated cycling of the gasket 330 in its various modes of operation revealed each of these capabilities as very important and marked improvements over previous attempts at improved performance of the gasket 330. The added gasket deflection or flexure pad or bead 336 enabled much improved gasket shape memory wherein after deflection, such as when seal 28 is removed, the gasket 330 more quickly returned to its pre-deflection, original shape and position to rest against the flange 284.

Initial efforts were aimed primarily at eliminating the flash problem that is sometimes encountered during in-place injection molding and during separate molding and subsequent placement and welding of the gasket 330. Subsequent post-fabrication tests of the operational performance of the gasket 330 were also performed in connection with the removal of the seal 28. In testing, the gasket 330 performed far better than prior attempts when fabricated with the improved flow management channel or stress/shape memory boss and load distributor or bead 336.

Figure 13:
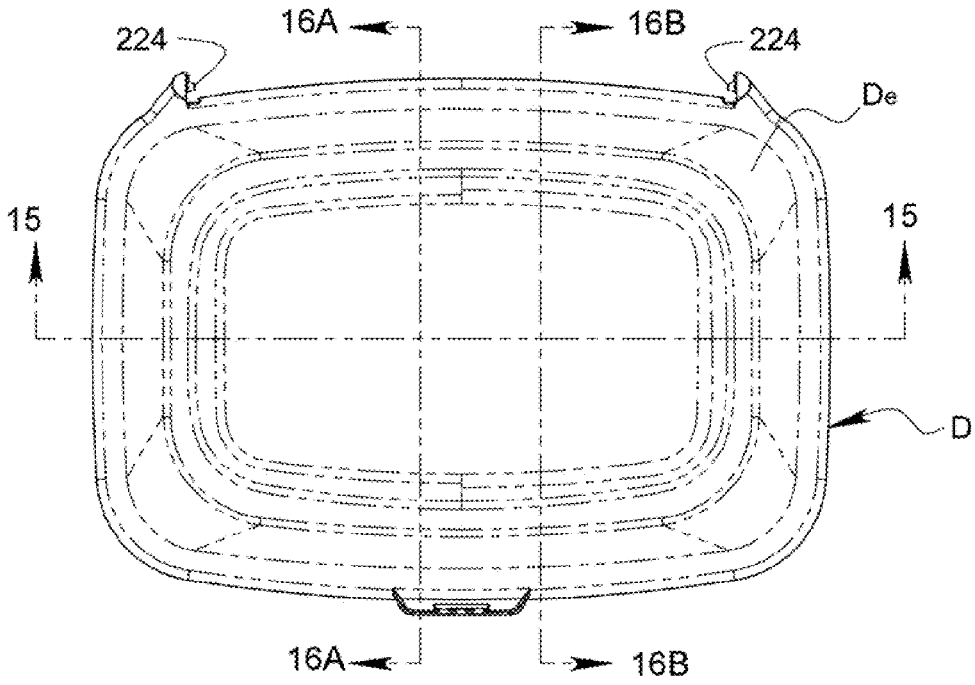
FIG. 13 is a top view of the embodiment of the container of FIGS. 1-4 showing the lid or top wall including the lid assembly.

Further gasket 330 testing of the in-place molded and premolded, placement, and in-place affixing (melt and glue and combination methods) configurations confirms yet other suspected improved capabilities of the gasket 330. To wit, the added root strengthening arrangement also demonstrates drastically improved shear strengthening, which enables faster fabrication injection molding and or placement and welding operations. These various improvements and the resultant, new gasket 330 performance capabilities, lowers production costs while dramatically improving product quality. Other modifications to the preferred embodiments of the container 210 may incorporate a modified removable lid such as lid "D" shown in FIGS. 13 through 16. The new variation contemplated by removable lid "D" preferably defines the interior surface "$D_i$" to be sized to cover and seal the opening to the interior space "I" when the lid "D" is closed. The lid "D" incorporates a sealing wall 340 depending from its interior surface "$D_i$" and that projects toward the sealing flange 284 and which is centered and aligned by including optionally preferred alignment and or wall ribs 341 (FIGS. 14A, 14B).

With this configuration, when the lid "D" is closed on the collar 300 to seal the container 210, the gasket 330, the sealing wall 340, and the sealing flange 284 are dimensioned and positioned so that the sealing wall 340 depresses and biases the flexible gasket 330 against the internal edge 286 of the sealing flange 284 to seal the subcollar space 320 from the container interior "I". The flexibility and shape memory and strength of the flexible gasket 330 must also withstand repeated opening and closing of the lid "D" and biasing and unbiasing of the gasket 330 by the moving sealing wall 340, so that the flexible gasket remains biased and at rest against the sealing flange 284.

The sealing wall 340 is preferably dimensioned so that when the lid "D" is closed, the sealing wall 340 remains inward of the sealing flange 284. Other optionally preferred variations of the position of the sealing wall 340 are contemplated as shown with the dashed line representation of sealing wall 340 shown in FIG. 11. In any of the possibly preferred positions of sealing wall 340, the length and or location of the downwardly projecting lower edge 342 is adjustable as preferred so that the lower edge 342 can, when lid "D" is in the closed position, terminate just above, bias against, and or bias against and depress gasket 300 downward so that gasket 330 is in turn biased against sealing flange 284.

In further alternative variations to the preceding embodiments, the flexible gasket 330 may be attached to the sealing wall 340 instead of the raised seat 325. In further variations, a second gasket (not shown) may be attached to the sealing wall 340 either alone and or in addition to and to cooperate with the flexible gasket 330 that is attached to the raised seat 325.

Figure 12A:
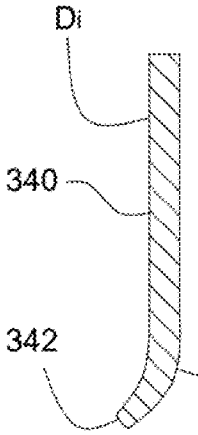
FIGS. 12A and 12B are representative detail views of alternative variations of the sealing wall illustrated in FIG. 11.
Figure 12B:
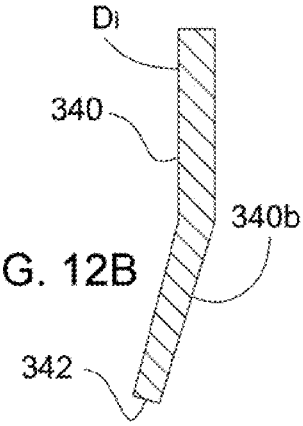

In still other modifications to any of the variations of the preferred embodiments, the sealing wall 340 may be implemented to function with or without the use of a gasket 330 and may include a funneled lower edge 342 such as those shown in FIGS. 12A and 12B. In FIG. 12A, the funneled lower edge 342 includes an inwardly curved and or inwardly tapering sealing wall 340*a*. In FIG. 12B, the funneled lower edge 342 incorporates an inwardly slanted and or tapering sealing wall 340*b*. A combination of a slanted and or curved and tapering wall 340*a* and 340*b* is also contemplated, which can be used either alone and or in combination with the flexible and or integral gasket 330 illustrated elsewhere herein.

The arrangement of the flexible gasket 330 biased at rest against the sealing flange 284 further cooperates to mostly if not entirely prevent the contents from entering the subcollar space 320 while directing the contents back into the interior space "I". Additionally, the arrangement of the flexible gasket 330 and its internal edge 332 extending inwardly beyond the internal edge 286 of the sealing flange 284 also serves to better direct the contents away from the subcollar space 320 and into the interior space "I". Also, the powder directing capabilities can be further implemented with any combination of the flexible and integral gaskets 330, whether used alone and or in combination with the straight, funneled, curved, and slanted sealing wall 340 variations described above.

As previously described in connection with earlier embodiment and variations thereof, a living hinge or a mechanical hinge can be used to hingedly and or pivotally attach the lid "D" to the collar 300. Referring to FIGS. 9 and 13, among others, it can be seen that the mechanical hinge adaptation can include the hinge 224 having a hinge element separation or wheel base that is farther apart than earlier described embodiments, which can improve the strength thereof. Another possibly preferred mechanical hinge can include a pinned hinge having cooperative detents and engagement ridges that enable a frictional ratcheting of the lid "D" between the open and closed positions, which prevents the lid "D" from falling closed while contents are being removed from the interior space 320.

In another contemplated variation of the preferred embodiments of the invention, the receptacle 280 of the container 210 is further modified to incorporate a means to compensate for changing external pressures due to altitude changes of the sealed container 210. Ordinarily, the container 210 is sealed with impervious seal 28 whereby the pressure in the interior space "I" remains unchanged. However, distribution of container 210 after filling with salable contents creates the probability that the filled and sealed containers 210 will experience widely varying pressure changes. Such changes may lead to deformation of the container 210 and even breach or rupture of the impervious seal 28. A stronger, pressure resistant seal 28 may be undesirable because the user may not have enough strength to open the impervious seal 28.

Figure 3:
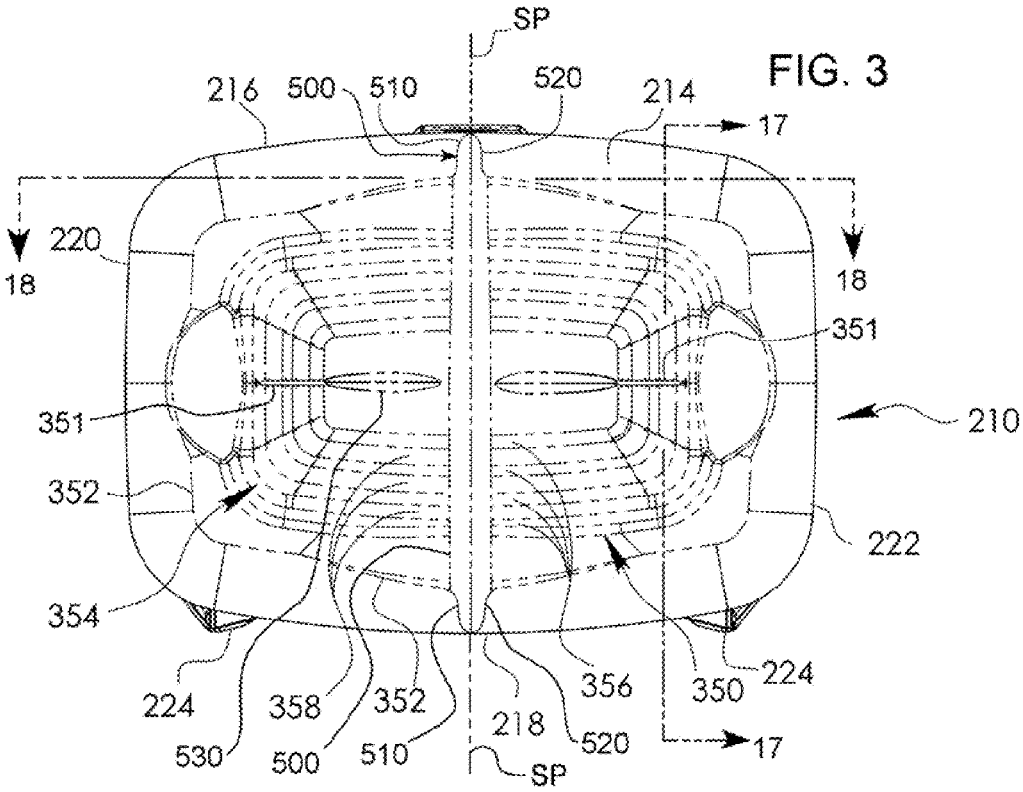
FIG. 3 is an underside view of the container of FIGS. 1 and 2 showing features of the bottom wall of the container that include a stiffener channel and stepped pressure compensating features.
Figure 17:
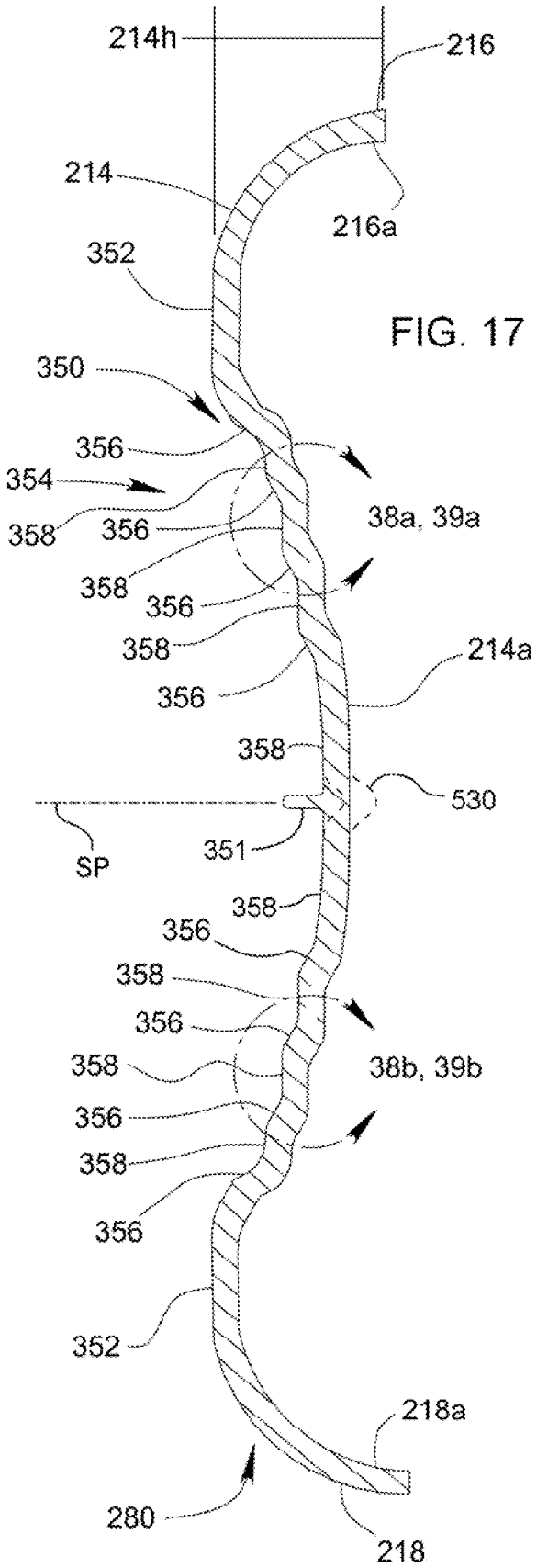
FIG. 17 is a section view of the container of FIG. 3 taken along section line 17-17, with certain elements of the container removed for clarity, and showing the bottom pressure compensating and or stepped portion modification to the bottom.
Figure 18A:
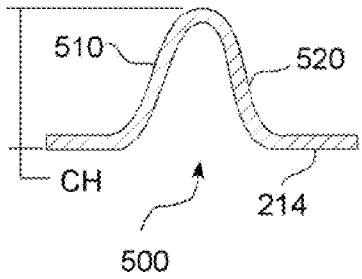
FIG. 18A is partial section view taken about section line 18-18 in FIG. 3 and illustrating an optionally preferred variation of a stiffened, flexible bottom wall with the sagittal stiffening channel defined by stiffener walls that are substantially symmetrical.
Figure 18B:
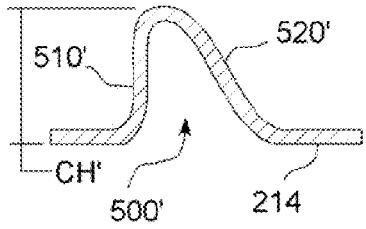
FIG. 18B is partial section view also taken about section line 18-18 in FIG. 3, but illustrating the stiffened, flexible bottom wall with the sagittal stiffening channel defined by another optionally preferred arrangement wherein the stiffener walls are substantially asymmetrical.

Accordingly, as can be seen with reference to FIGS. 2, 3, and 17, the bottom surface 214*a* of the bottom wall 214 of the receptacle 280 may incorporate a pressure control portion formed from a stepped or central raised stepped or stiffener portion 350 formed with an outer planar portion 352 adapted to enable the container 210 to rest in a level position on a flat surface such as a table or counter-top.

The pressure control portion is also referred to as the central raised stiffener portion 350. Contrary to the plain meaning of the word "stiffener", this phrase refers to features that may be incorporated and which include, for purposes of example without limitation, a flexible and or collapsible pressure relief section.

Extending towards the interior space "I", the central raised stepped or stiffener portion 350 includes a plurality of steps 354 having riser portions 356 and tread portions 358. The riser portions 356 preferably project in a direction substantially upward relative to the outer planar portion 352 with the tread portions 358 being approximately parallel to the outer planar portion 352.

More preferably, the steps 354 that are formed from the riser and tread portions 356, 358 can form 3, 4, 5 or more or less steps that together can enable an incremental reduction in pressure by the incremental collapse of one or all of the steps so that pressure in the interior space "I" may be lowered to compensate for unequal pressure and to lessen any pressure between the interior space "I" and the external atmosphere. In this way, when a container such as container 210 are filled and sealed with contents at a sea level factory, and the containers are shipped via aircraft or over high-altitude land routes, the impervious seal 28 of the container 210 may remain intact despite varying external pressures.

Alternatively, the steps 354 may be adapted to have a thickness and or a bellows and or an accordion cross-sectional structure similar to that shown in FIGS. 2, 3, and 17 that establishes a material strength that while enabling pressure change compensation, prevents collapse and that resists permanent deformation of the bottom wall 214 when exposed to such pressure differentials.

With the multiple stepped arrangement illustrated here, the collapse of one or more steps 354 will preferably not result in the central stepped portion 350 distending beyond the generally level outer planar portion 352. Such pressure differentials may be experienced even without altitude changes. For example, and as discussed elsewhere herein, the containers of the invention may be subjected to external crushing pressures during shipment with a commercial carrier as well as during movement by a parent carrying the inventive container in a diaper bag.

In past attempts to fabricate a sealable container that could accommodate pressure changes, features such as the pressure control portion 350 were combined with features such as stiffener 351 (FIG. 3) that extended outwards from the exterior surface of the bottom wall 214. While generally accepted engineering principles analytically predicted success, and although initial field tests demonstrated reasonably good results under nearly all environmental conditions, permanent distension and deformation of containers after delivery and or purchase nevertheless occurred. As a result, continued investigations were required to reduce and eliminate such issues.

Regardless of the studied investigations, inspiration from an unexpected source opened an avenue of inquiry along a path counter-intuitive to the usual engineering modeling and evaluation methods. Without any initial practical support from analytical or generally accepted, design rules of thumb, a new approach was subjected to analyses and tests with extraordinary results that not only surpasses expectations, but which exceeded more studied previous designs by substantial margins.

Alone and when combined with earlier pressure control feature designs, the new approach resulted in container performance that resisted higher pressure differentials. Subsequent field testing confirmed analytical models giving rise to the container 210 being complemented about its bottom wall 214 with at least one stiffening channel 500 (FIGS. 1, 2, 3, 18A, 18B).

Preferably, the stiffening channel 500 extends along the bottom wall 214 from the lower portion of the front wall 216*e* to the lower portion of the lower rear wall 218*e*, or sagittally from front to rear. More preferably, the sagittal stiffening channel also depends upwardly from the bottom wall 214 and into the interior space "I".

In this arrangement, the pressure control portion 350 of the bottom wall 214 can flexibly deflect to compensate for post-sealing pressure differentials without permanent distension and deformation of the bottom wall 214. Instead, the bottom wall 214 and the pressure compensating or control portion 350 substantially maintains its profile even under the most extreme pressure differentials experienced across the geographic distribution chain of the sealed container 210.

Further investigations into the performance of the unexpectedly innovative sagittal stiffening channel 500 revealed that so long as the sagittal stiffening channel 500 was arranged as described, the container 210 resisted greater pressure differentials regardless of its location along the bottom wall 214. However, improved pressure differential performance was demonstrated when the sagittal stiffening channel 500 was substantially centered about the bottom wall 214 of the container about an imaginary, sagittally centered plane "SP" (FIGS. 3 & 17) passing through the container 210 from front to back.

The contemplated sagittal stiffening channel 500 also enabled the so modified container 210 to outperform previous design even if the channel 500 was located off-center or was substantially offset on either side of the imaginary sagittal center plane SP.

The discovery of the effectiveness of the sagittally arranged stiffening channel 500 led to additional inquiries wherein other optionally preferred modifications were found to further enhance the pressure differential performance of the container 210. In one such alternative variation, the sagittal stiffening channel 500 was formed with stiffener walls 510 and 520 that were substantially symmetrical (FIG. 18A) and which depended upwardly from the bottom wall 214 and into the interior space "I" of the container 210.

More preferably, the stiffener walls were found to offer even better performance wherein the walls 510', 520' (FIG. 18B) were asymmetrically configured. In this optionally preferred embodiment, at least one of the stiffener walls 510' depended upwardly in a substantially vertical direction, and preferably substantially parallel to one or both of the opposite side walls 220, 222.

The other stiffener wall 520' is preferably not symmetrical with the stiffener wall 510' and is not parallel to the side walls 220, 222. Instead, the corresponding stiffener wall 520' more preferably depends into the interior space "I" in a substantially non-vertical and generally angled direction relative to the at least one vertically depending stiffener wall 510' and opposing side walls 220, 222.

In establishing the most effective configuration of the sagittal stiffening channel 500, the bottom wall 214 of the container 210 is defined to have a height 214*h* (FIGS. 4 and 17), which extends from a bottom-most surface of the bottom wall 214 to a point where the bottom wall is joined to or transitions into any one of the front, back, and or opposite side walls 216*e*, 218*e*, 220*e*, 222*e*.

When compared to the bottom wall 214 height 214*h*, the sagittal stiffening channel 500 was found to substantially improve the strength and stiffness of the container 210, and especially the bottom wall 214, when the height "CH" (FIGS. 18A & 18B) of the sagittal stiffening channel 500 was approximately between 25 and 50 percent of the bottom wall height 214*h*. Even more preferably, the height "CH" of the sagittal stiffening channel 500 is approximately 50 percent of the height of the bottom wall 214*h*.

The various additional engineering performance inquiries into the surprising performance improvements enabled by the stiffening channel 500 also led to the discovery that an additional transverse stiffening channel 530 (FIGS. 3 and 17) positioned substantially orthogonally to the channel 500 enabled further resistance to permanent deflection and deformation of the bottom wall 214 of the container 210. Even more preferred results were achieved where the height of the transverse stiffening channel 530 was configured to be approximately between 10 and 80 percent of the stiffening channel height CH, and most preferably between about 30 and 60 percent of the channel height CH.

In the fields of structural mechanics and physics, and specifically in the field of the behavior of materials under static and dynamic environments, these arrangements increase the structural rigidity of the affected component, which in turn increases its respective load carrying capacity. In the context of the contemplated seal 28, 400, the seal thereby becomes more structurally rigid and less prone to crippling or buckling during the manufacturing process and prior to assembly onto the container 210.

Even more importantly, the substantially randomized pattern also establishes a generally or substantially homogeneous local stress and strain dispersement action both across the seal 28, 400 and internally between layers of the seal 28, 400. This action further diminishes the likelihood of locally manifested stress and strain concentrations. In turn, this action increases the structural stability and rigidity of and reduces the probability of crippling or buckling of any portion of the seal 28, 400 during pre-assembly handling and transportation. This stress and strain management capability also improves the performance of the pull-tab or peel tab 28*a* during peeling and removal of the seal 28, 400 as the container 210 is opened for the first time after sealing.

In any of the arrangements that incorporate structural stability control elements, the height or offset distance of the embossment or stippling from the neutral plane of the seal 28, 400 establishes a predetermined and precision moment of inertia for the impervious barrier seal 28, 400. Additionally, using various structural mechanics analytical techniques for thin-walled structures, the crippling and buckling strengths may be mathematically predicted with a substantial degree of certainty.

More preferably, the seal 28, 400 can be modified in any of its various preferred embodiments to be a removable, stability enhanced and or controlled seal that includes new and novel features that further minimize manufacturing material costs. The contemplated and preferable alternatives may also improve manufacturability of joining the seal 28, 400 to the sealing flange 284, and greatly increase the convenience with which users and consumers may peel away and remove the seal 28, 400 to gain access to the product contained in the container 210.

In connection with seeking to further the capabilities of many of the preceding embodiments of the seal 28, 400, investigations into difficulties in peelability and in removing the seal 28, 400 revealed a new opportunity that was counter-intuitive to design assumptions and expectations. The result was an unexpectedly simplified design that decreased material cost, and simplified and reduced manufacturing time, substantially increasing ease of peelability.

Additionally preferred and optional variations to any of the preceding arrangements of the seal 28, 400 are contemplated for use in further enhancing the performance of pull or peel tab 28*a* as well as the seal itself. During fabrication of the seal 28, 400, a blank is typical punched from a sheet of raw material that has been prepared as already described elsewhere herein.

The blank will typically conform to the general shape of the seal 28, 400 and will have the pull or peel tab 28*a* extending outwardly and away from its respective corner of the seal 28, 400.

In other also optionally preferred variations, additional polymeric material layers, embossments, appliquacues, or components may be added to either the entire seal 28, 400, of may be added only to the portion of the seal 28, 400 proximate to the peel tab 28*a*. For example, for applications requiring additional strength, the seal 28, 400 may be optionally modified with a preferable additional layer that can include, for example without limitation, a synthetic flashspun, non-woven high-density polyethylene ("HDPE") fibrous material that may incorporate olefin fibers, such as a sheet material commonly sold under the DuPont trademark "Tyvek" or similar materials.

Operation

In use, the container 210 is grasped with a single hand using the enhanced gripping recesses 226*a*, 226*b*, 227*a*, 227*b*. The container 210 is then opened by opening the lid and breaking the seal 76, if necessary for a new container, the impervious seal 28 is removed by grasping the pull tab 28*a* and pulling the seal 28 away from the sealing flange 284. Next, the user uses his or her free hand to retrieve the scoop 32 from the lid "D" of the container 210 to scoop and dispense the product contents. The user avoids the inconvenience of powder spilling from the scoop 32 because the bowl 36 was covered by scoop cover bracket 30*a*.

Furthermore, any powdered contents that may have come to rest in the lid "D" prior to opening, was directed away from the subcollar space 320 and into the interior space "I" where it remains ready for dispensing. The container 210 and the scoop 32 together cooperate as a system that enables the user to conveniently use the scoop 32 to remove a predetermined volume or portion of the contents of the container.

After the scoop 32 has been used, the scoop 32 can be reattached to the scoop holder 30 on the lid "D" for all subsequent times the scoop is to be used. The lid is then closed, securing the powder therein. Accordingly, the granular or powdered product will not be spilled, wasted, or contaminated by contact with the hand of the user.

Industrial Applicability

The embodiments of the present invention are suitable for use in many applications that involve manufacture, distribution, storage, sale, and use of flowable substances such as powders and granular materials. The configurations of the inventive container can be modified to accommodate nearly any conceivable type of such materials, and the shape, size, and arrangement of the features and components of the novel container can be modified according to the principles of the invention as may be required to suit a particular type or quantity of flowable material, as well as a preferred mode of use, storage, manufacture, distribution, and or sales environment.

Such modifications and alternative arrangements may be further preferred and or optionally desired to establish compatibility with the wide variety of possible applications that are susceptible for use with the inventive and improved containers for containing flowable materials are described and contemplated herein. Accordingly, even though only few such embodiments, alternatives, variations, and modifications of the present invention are described and illustrated, it is to be understood that the practice of such additional modifications and variations and the equivalents thereof, are within the spirit and scope of the invention as defined in the following claims.

The invention claimed is:

1. A sealable container, comprising:

a stiffened, flexible bottom wall joined to front, rear, and opposite side walls enclosing an interior space and defining interior and exterior surfaces, the front, rear, and opposite side walls extending to an upper finish formed with a sealing flange having an internal edge defining an opening to the interior space;

a collar having an interior surface received about the container proximate the upper finish;

an openable lid having an interior surface and carried from the collar such that when closed the lid covers and seals the opening, the lid including a sealing wall depending from its interior surface and projecting toward and engaging the sealing flange when the lid is closed;

at least one transverse stiffener channel formed about the bottom wall and depending therefrom into the interior space; and the stiffened and flexible bottom including at least one sagittal stiffening channel defined by at least two opposing stiffener walls;

wherein at a length along the channel, the at least two walls with respect to each other depend from the exterior surface of the bottom wall towards the interior space at different angles with respect to a horizontal direction.

2. The sealable container according to claim 1, wherein one of the at least two opposing stiffener walls depends from the exterior surface of the bottom wall towards interior space and perpendicular with respect to a horizontal direction.

3. A sealable container, comprising:

a substantially flexible and stiffened bottom wall joined to front, rear, and opposite side walls enclosing an interior space and defining interior and exterior surfaces, the front, rear, and opposite side walls extending to an upper finish formed with a sealing flange having an internal edge defining an opening to the interior space;

a collar having an interior surface received about the container proximate the upper finish;

an openable lid having an interior surface and carried from the collar such that when closed the lid covers and seals the opening, the lid including a sealing wall depending from its interior surface and projecting toward and engaging the sealing flange when the lid is closed;

a flexible gasket carried from the interior surface of the collar to flexibly rest against the sealing flange; and a scoop holder including substantially opposing scoop cover and bowl brackets projecting from the interior surface of the lid in the direction of the interior space, and at least one scoop capture element integrally formed about at least one of the scoop cover and bowl brackets, wherein the scoop cover bracket is configured to substantially cover an open side of the scoop bowl.

4. The sealable container according to claim 3, wherein the at least one scoop capture element is a capture latch depending from the opening cover bracket to have at least one edge projecting in a direction substantially orthogonal to a plane defined by the cover bracket.

5. The sealable container according to claim 4, further comprising a handle rest formed about the interior surface of the lid to cooperate with a capture latch integrally formed about the scoop cover bracket to establish a force couple limited to two endpoints;

wherein the scoop holder is adapted to capture a scoop having a handle attached to a bowl by nesting and biasing the bowl between the opposing bowl and scoop covers and by imposing the force couple about the handle with the two endpoints established at the capture latch and the handle rest; and whereby the two endpoints are substantially proximate to the bowl to enable the handle to flex.

6. The sealable container according to claim 3, wherein the at least one scoop bowl capture element depends from at least one extent of at least one of scoop bowl and cover brackets.

* * * * *